US011892222B2

(12) United States Patent
Dodson

(10) Patent No.: US 11,892,222 B2
(45) Date of Patent: Feb. 6, 2024

(54) SNOWMAKING AUTOMATION SYSTEM AND MODULES

(71) Applicant: SL USA, LLC, Huntington Beach, CA (US)

(72) Inventor: Mitchell Joe Dodson, Park City, UT (US)

(73) Assignee: SL USA, LLC, Huntington Beach, CA (US)

( * ) Notice: Subject to any disclaimer, the term of this patent is extended or adjusted under 35 U.S.C. 154(b) by 0 days.

(21) Appl. No.: 17/962,970

(22) Filed: Oct. 10, 2022

(65) Prior Publication Data

US 2023/0041925 A1 Feb. 9, 2023

Related U.S. Application Data

(63) Continuation of application No. 17/187,617, filed on Feb. 26, 2021, now Pat. No. 11,466,915, which is a continuation of application No. 15/092,574, filed on Apr. 6, 2016, now abandoned.

(60) Provisional application No. 62/143,776, filed on Apr. 6, 2015.

(51) Int. Cl.
*F25C 3/04* (2006.01)

(52) U.S. Cl.
CPC ..... *F25C 3/04* (2013.01); *F25C 2303/0481* (2013.01); *F25C 2600/04* (2013.01)

(58) Field of Classification Search
CPC ..... F25C 3/00; F25C 3/04; F25C 2303/0481; F25C 2600/04
See application file for complete search history.

(56) References Cited

U.S. PATENT DOCUMENTS

| | | | |
|---|---|---|---|
| 2,564,896 A | 8/1951 | Gustafsson et al. | |
| 2,676,471 A | 4/1954 | Pierce, Jr. | |
| 3,513,906 A | 5/1970 | Richards | |
| 3,761,020 A | 9/1973 | Tropeano et al. | |
| 4,545,529 A | 10/1985 | Tropeano et al. | |
| 4,717,072 A | 1/1988 | Girardin | |

(Continued)

FOREIGN PATENT DOCUMENTS

| | | | |
|---|---|---|---|
| EP | 1182409 | 2/2002 | |
| EP | 1182409 A1 * | 2/2002 | ..... E01C 19/006 |

(Continued)

OTHER PUBLICATIONS

Machine translation for EP-1182409 (Year: 2002).*

(Continued)

*Primary Examiner* — Joseph F Trpisovsky
(74) *Attorney, Agent, or Firm* — Sheridan Ross P.C.

(57) ABSTRACT

The invention is a snowmaking automation system and snowmaking automation modules for use with snowmaking guns and hydrants. Embodiments of the snowmaking automation modules described herein may be battery powered, and thus do not require fixed electrical infrastructure, but are designed to use such infrastructure if present on the mountain. In some embodiments, various components of the snowmaking automation system may be wireless and thus do not require hard-wired communications, for example between base stations, servers, databases, repeater nodes and remotely controlled snowmaking guns and hydrants with their snowmaking automation modules installed.

20 Claims, 14 Drawing Sheets

(56) References Cited

U.S. PATENT DOCUMENTS

| | | | | |
|---|---|---|---|---|
| 4,889,180 | A | 12/1989 | Sloan | |
| 5,004,151 | A | 4/1991 | Dupre | |
| 5,031,832 | A | 7/1991 | Ratnik et al. | |
| 5,121,329 | A | 6/1992 | Crump | |
| 5,180,105 | A | 1/1993 | Teague | |
| 5,230,218 | A | 7/1993 | Clulow | |
| 5,400,965 | A | 3/1995 | Ratnik et al. | |
| 5,603,228 | A | 2/1997 | Barthold et al. | |
| 5,628,456 | A | 5/1997 | Dupre | |
| 5,667,137 | A | 9/1997 | Dupre | |
| 5,699,961 | A | 12/1997 | Ratnik et al. | |
| 5,718,378 | A | 2/1998 | Dupre | |
| 5,749,517 | A | 5/1998 | Dupre | |
| 5,836,513 | A | 11/1998 | Smith et al. | |
| 5,836,514 | A | 11/1998 | Handfield | |
| 5,884,841 | A | 3/1999 | Ratnik et al. | |
| 5,890,654 | A | 4/1999 | Dupre | |
| 5,920,827 | A | 7/1999 | Baer et al. | |
| 5,930,743 | A | 7/1999 | Warren | |
| 6,402,047 | B1 | 6/2002 | Thomas | |
| 6,454,182 | B1 | 9/2002 | Buceri | |
| 6,466,870 | B2 | 10/2002 | Satonaka | |
| 6,508,412 | B1 | 1/2003 | Pergay et al. | |
| 6,554,200 | B1 | 4/2003 | Satonaka | |
| 6,805,150 | B1 | 10/2004 | Dion et al. | |
| 7,290,722 | B1 | 11/2007 | Ewald | |
| 8,027,636 | B2 | 9/2011 | DeMarco et al. | |
| 9,170,041 | B2 | 10/2015 | Dodson | |
| 9,200,825 | B2 | 12/2015 | Rieder | |
| 9,772,134 | B2 | 9/2017 | Dodson | |
| 10,557,658 | B2 | 2/2020 | Dodson | |
| 11,466,915 | B2 | 1/2022 | Dodson | |
| 2005/0001049 | A1 | 1/2005 | Schultz et al. | |
| 2006/0018719 | A1 | 1/2006 | Stern | |
| 2009/0114735 | A1* | 5/2009 | Collins | F25C 3/04 239/2.2 |
| 2009/0140069 | A1 | 6/2009 | Landreau et al. | |
| 2009/0294547 | A1 | 12/2009 | Ichinomiya et al. | |
| 2011/0174895 | A1 | 7/2011 | Ratnik et al. | |
| 2011/0240756 | A1 | 10/2011 | Santry | |
| 2012/0175428 | A1 | 7/2012 | Jouneau et al. | |
| 2012/0286060 | A1 | 11/2012 | Korobochkin | |
| 2013/0218352 | A1 | 8/2013 | Iovanni et al. | |
| 2013/0264032 | A1 | 10/2013 | Ahmad et al. | |
| 2014/0091158 | A1 | 4/2014 | Rieder | |
| 2015/0362925 | A1 | 12/2015 | Uy et al. | |
| 2016/0115675 | A1 | 4/2016 | Quigley et al. | |
| 2016/0179105 | A1 | 6/2016 | Cregg | |
| 2016/0290699 | A1 | 10/2016 | Dodson | |
| 2017/0370057 | A1 | 12/2017 | Miller | |

FOREIGN PATENT DOCUMENTS

| | | | | |
|---|---|---|---|---|
| EP | 3268683 | | 1/2018 | |
| EP | 3280961 | | 2/2018 | |
| JP | H05-113277 | | 5/1993 | |
| JP | H06-082134 | | 3/1994 | |
| KR | 10-2000-0039592 | | 7/2000 | |
| KR | 20020006111 | A * | 1/2002 | F25C 3/04 |
| KR | 100380665 | | 4/2003 | |
| WO | WO 94/03764 | | 2/1994 | |
| WO | WO 2016/149224 | | 9/2016 | |
| WO | WO 2016/164500 | | 10/2016 | |

OTHER PUBLICATIONS

Machine translation for KR-20020006111 (Year: 2002).*
Official Action for Canada Patent Application No. 2981878, dated Dec. 20, 2022, 5 pages.
"Control Software: ATASSplus," Techno Alpin Snow Experts, archived webpage dated Mar. 27, 2016, retrieved from https://web.archive.org/web/20160327121057/http://www.technoalpin.com/en-us/solutions/control-software.html, 2 pages.
"Control Software: Liberty," Techno Alpin Snow Experts, archived webpage dated Nov. 2, 2016, retrieved from https://web.archive.org/web/20161102190137/http://www.technoalpin.com/en-us/solutions/control-software/liberty.html, 2 pages.
"Klik Auto," HKD Snowmakers, date unknown, retrieved Jan. 21, 2022 from https://www.hkdsnowmakers.com/products/klik-auto/, 8 pages.
"Why Automate?," Snow Makers Inc, archived webpage dated Feb. 24, 2015, https://web.archive.org/web/20150224063155/http://snowmakers.com/why-automate.html, 6 pages.
HKD Snowmakers, HKD KLiK Automatic Data Sheet.
Snow Machines, Inc., SMI SmartSnow Automatic Hydrant Actuator Brochure.
Snow Machines, Inc., SMI SmartSnow Automation Brochure.
Snow Machines, Inc., SMI SmartSnow Software & Control System Brochure.
Techno Alpin Snow Experts ATASSplus Brochure.
Techno Alpin Snow Experts Liberty Brochure.
International Search Report and Written Opinion for International (PCT) Patent Application No. PCT/US2016/026274, dated Aug. 29, 2016, 17 pages.
International Preliminary Report on Patentability for International (PCT) Application No. PCT/US2016/026274, dated Oct. 19, 2017, 9 pages.
Extended European Search Report for European Patent Application No. 16777226.8, dated Oct. 24, 2018, 8 pages.
Intent to Grant (with Bibliographic Data and Text Intended for Grant) for Europe Patent Application No. 16777226.8, dated Nov. 11, 2021, 49 pages.
Official Action for U.S. Appl. No. 15/092,574, dated May 7, 2018, 8 pages. Restriction Requirement.
Official Action for U.S. Appl. No. 15/092,574, dated Oct. 12, 2018, 14 pages.
Official Action for U.S. Appl. No. 15/092,574, dated Aug. 26, 2020, 15 pages.
Official Action for U.S. Appl. No. 17/187,617, dated Oct. 28, 2021, 15 pages.
Notice of Allowance for U.S. Appl. No. 17/187,617, dated May 24, 2022, 10 pages.
International Search Report and Written Opinion for International (PCT) Patent Application No. PCT/US2016/022393, dated Jul. 13, 2016, 7 pages.
Official Action for Canada Patent Application No. 2979684, dated Dec. 2, 2022, 4 pages.
Extended European Search Report for Europe Patent Application No. 16765574.5, dated Sep. 7, 2018, 5 pages.
Article 94(3) Communication for Europe Patent Application No. 16765574.5, dated Aug. 27, 2019, 3 pages.
Intent to Grant Europe Patent Application No. 16765574.5, dated May 9, 2023, 8 pages.
Notice of Allowance for Canada Patent Application No. 2981878, dated May 31, 2023, 1 page.
Official Action for U.S. Appl. No. 15/069,945, dated Nov. 30, 2016, 6 pages.
Notice of Allowance for U.S. Appl. No. 15/069,945, dated Jun. 21, 2017, 8 pages.
Official Action for U.S. Appl. No. 15/716,166, dated Mar. 4, 2019, 9 pages.
Notice of Allowance for U.S. Appl. No. 15/716,166, dated Aug. 26, 2019, 8 pages.

* cited by examiner

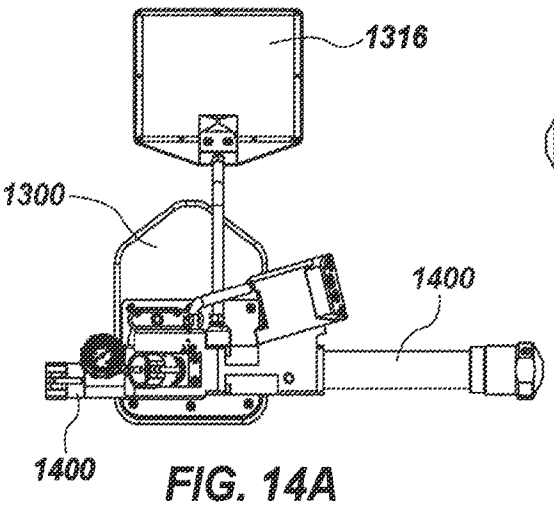
FIG. 14A
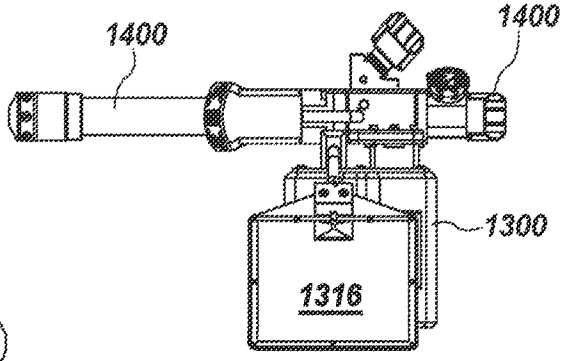
FIG. 14B
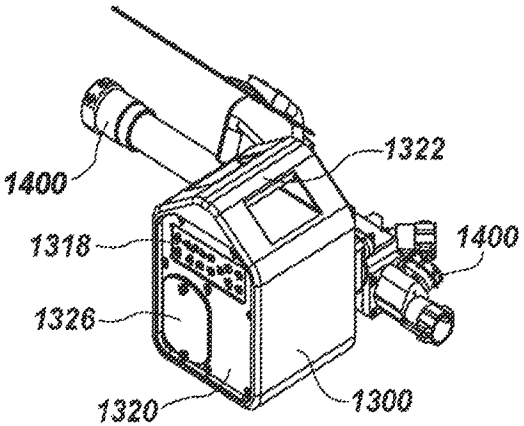
FIG. 14C
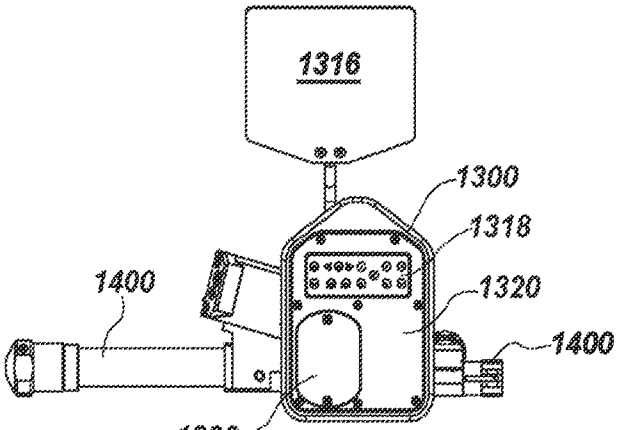
FIG. 14D
FIG. 14E
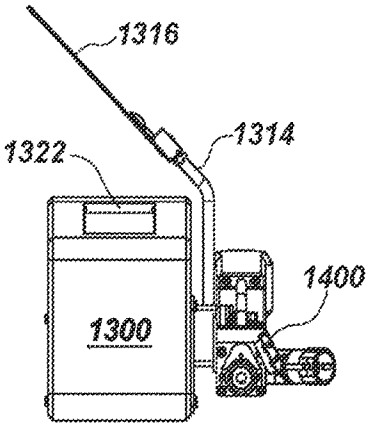
FIG. 14F

SNOWMAKING AUTOMATION SYSTEM AND MODULES

CROSS-REFERENCE TO RELATED APPLICATIONS

This U.S. Non-Provisional patent application is a Continuation of U.S. Non-Provisional patent application Ser. No. 17/187,617, filed on Feb. 26, 2021, which claims benefit and priority to U.S. Non-Provisional patent application Ser. No. 15/092,574, filed on Apr. 6, 2016, which claims benefit and priority to U.S. Provisional Patent Application No. 62/143,776, filed on Apr. 6, 2015, the entire disclosures of which are hereby incorporated by reference.

This application is also a counterpart to an international patent application No. PCT/US2016/026274, filed, Apr. 6, 2016, titled: "SNOWMAKING AUTOMATION SYSTEM AND MODULES", which was timely entered into the regional phase of the European Patent Office as European patent application No. EP16777226.8, and which issued on May 25, 2022, as European Patent No. EP3280961.

This U.S. nonprovisional patent application is also related to U.S. nonprovisional patent application Ser. No. 15/069,945, filed, Mar. 14, 2016, titled: "DUAL AUTO HYDRANT FOR SNOWMAKING EQUIPMENT AND METHOD OF USING SAME", which issued on Oct. 6, 2016, as U.S. Pat. No. 9,772,134; and U.S. continuation patent application Ser. No. 15/716,166, filed, Sep. 26, 2017, titled: "DUAL AUTO HYDRANT FOR SNOWMAKING GUN AND METHOD OF USING SAME", which issued on Feb. 11, 2020, as U.S. Pat. No. 10,557,658. The contents of all of the above applications are hereby incorporated by reference for all purposes as if fully set forth herein.

BACKGROUND OF THE INVENTION

Field of the Invention

The present invention relates generally to systems and methods for making artificial snow. More particularly, this invention relates to automated systems for controlling the making of artificial snow. Still more particularly, the snowmaking automation system of the present invention provides remote automated control of snowmaking guns, compressed air sources and water hydrants arbitrarily located at a ski resort.

Description of Related Art

Snowmaking equipment is commonly used at ski resorts to supplement natural snowfall when needed to adequately cover ski slope terrain otherwise covered with dirt, surface plants, gravel, rocks and other debris that prevents safe skiing or boarding on snow. Snowmaking equipment always requires a source of water from which snow may be created from atomized mists of water droplets that may, or may not, be seeded with nucleating ice crystals. Some snowmaking equipment requires electricity to run fans or operate equipment controls, data logging or other purposes. Still other snowmaking equipment may require a source of compressed air used to accelerate atomized mists of water droplets and optionally the nucleating ice crystals into the atmosphere so that the water droplets can freeze in the air before falling to the surface intended for the artificial snow.

Snowmaking guns, such as those offered by Snow Logic, Inc., Park City, Utah, typically require a source of water and a source of compressed air to operate. The water source may be a physical pipeline that has been installed to a key location on a ski slope for the purpose of snowmaking. Alternatively, a well, temporary pipe, water hose, or any other suitable water source may be used for snowmaking. Typically, the water source must be pressurized to deliver it to a particular elevation and for use in pressurizing or charging the snowmaking gun. Some conventional water sources may be a creek, reservoir or well from which water may be extracted and pumped, typically at a pump house, through a fixed, preferably buried pipeline up along a ski run with periodic hydrants (vertical pipes) that provide water at the surface for snowmaking.

Similarly, the compressed air source may be a compressed air pipeline, air hose, air compressor, or other suitable compressed air source that has been located adjacent to or near the desired location for snowmaking. Some conventional snowmaking systems have compressed air pipelines that may parallel the water pipelines, e.g., 2-3 feet apart up a ski slope, and again, preferably underground, e.g., about 4 feet below the surface. Pressurized air discharged from an air compressor is generally too hot at about, 180-200° F., for use in snowmaking. So, the heated compressed air may be initially cooled by a primary cooling device known as an aftercooler. The aftercooler may consist of pipes surrounded by cold water through which the air passes and cools. The cooling of the air may also cause condensation of the air's moisture which must also be removed to prevent frosting of the air hoses used subsequently to deliver pressurized air to a snow gun. So, the cooled air with some moisture removed leaves the aftercooler and may enter a secondary cooling device, known as a stripping tower. The stripping tower in essence freeze dries the cooled air and further removes moisture. The colder compressed air leaving the stripping tower may have dropped in temperature to a range of about 45-55° F. The compressed air and pressurized water pipelines may also serve to further reduce the temperature of both to a temperature range of about 34-35° F., and may further dry the compressed air, if uninsulated pipes are used. However, a water droplet passing through a conventional snow gun may range from 34-44° F. depending on how the water is sourced.

The snowmaking gun used to make artificial snow may also be used in combination with a hydrant for controlling the water source and for controlling the compressed air source. Snow Logic, Inc., offers a dual auto hydrant that can safely control both the water source and compressed air source feeding a snowmaking gun.

Conventional snowmaking guns and hydrants are typically manually operated by snowmaking staff at a ski resort. It is generally time consuming for ski resort staff to travel to any and all of the various locations on a given mountain where snowmaking equipment is located. Additionally, the ideal time to operate snowmaking equipment may be anytime during the day or night as long as the ambient temperature and snowmaking conditions are correct. Consequently, there may be undesirable labor costs associated with snowmaking. But, these are not the only problems associated with conventional snowmaking systems and prior attempts at automating the snowmaking process.

Another problem with conventional fixed location snowmaking automation is that it may rely on buried or above ground power to operate the system and actuators. Such automation is "fixed" because it is tied to the fixed location of the buried or above ground power source used to operate the system. The cost of electrical infrastructure necessary to automate every possible location where snowmaking is desired on the mountain of a ski resort is expensive and invasive to the environment. Many snowmaking guns at ski resorts do not have such electrical infrastructure. Yet another problem with conventional fixed location automation used by ski resorts is that it typically only runs an average of 110-160 hours per season. Depending on the cost of such fixed automation, this may result in a long duration (perhaps years) before reaching a return on the investment. Still another problem with such conventional fixed location automation systems is that repair and maintenance of such fixed location automation systems generally must be carried out in the field, i.e., on the mountain.

Additionally, resorts may not have trained or experienced staff to troubleshoot and repair fixed snowmaking automation systems. There is a significant labor cost associated with hiring, training and maintaining qualified staff, or hiring outside technicians to troubleshoot and repair fixed snowmaking automation systems. There will always be a need to troubleshoot and repair snowmaking automation over time during actual use. For example, any kind of snowmaking equipment may be subject to malfunction from electrical (lightning strikes) during storms or mechanical (frozen pipes, avalanches, etc.)

Conventional hydrants and their associate valving, if not properly drained when not in use, can become dangerous. For example, on Dec. 7, 1998, Kevin E. Turner, Environmental Manager, Homewood Ski Resort, Homewood, Calif. (west shore of Lake Tahoe), was severely injured when a brass ball valve installed between a hydrant and a snow gun failed because water froze inside the valve and caused the valve cap to partially separate from the valve body and ultimately exploded because of unreleased compressed air. *Kevin E. Turner* v. *Northern Indiana Brass Co. d/b/a NIBCO and Western Nevada Supply Co*., No SCV 9387, 2009 WL 132814 (Cal. Superior).

Finally, conventional snowmaking automation tends to be proprietary as it is made for a particular type (gun or fan) and brand of snowmaking gun. Thus, implementing snowmaking automation at a given resort becomes costly and difficult because the conventional snowmaking automation systems are generally tied to the particular guns already installed. Snowmaking automation is also expensive when replacing existing equipment with new equipment that supports the desired automation.

Accordingly, there exists a need in the art for automated snowmaking equipment for automatically generating artificial snow using hydrants and snowmaking guns, that reduces ski resort labor costs, solves at least some of the above identified problems with conventional fixed automation systems, and provides greater control over the snowmaking process.

SUMMARY OF THE INVENTION

An embodiment of a snowmaking automation system for remotely controlling the generation of snow is disclosed. The system may include a hydrant for selectively receiving and delivering pressurized water and compressed air. The system may further include a snowmaking gun coupled to the hydrant to selectively receive the pressurized water and the compressed air. The system may further include at least one automation module coupled to the hydrant or the snowmaking gun, each of the at least one automation modules having a means for communication and a motor for actuating the snowmaking gun or the hydrant to selectively generate snow using the water and the air. The system may further include a base station in communication with the at least one automation module, the base station configured to provide a user control of the at least one automation module and thereby remotely control generation of the snow.

An embodiment of a snowmaking automation module is disclosed. The module may include a housing with an actuator interface for attachment to a snowmaking gun or a hydrant. The module may further include a gear motor mounted inside the housing and coupled to the actuator interface, the gear motor configured to selectively drive a snowmaking gun or a hydrant. The module may further include a radio modem and antenna mounted inside the housing. The module may further include a battery mounted inside the housing, the battery coupled to, and configure for powering, the gear motor and the radio modem.

Additional features and advantages of the invention will be apparent from the detailed description which follows, taken in conjunction with the accompanying drawings, which together illustrate, by way of example, features of embodiments of the present invention.

BRIEF DESCRIPTION OF THE DRAWINGS

The following drawings illustrate exemplary embodiments for carrying out the invention. Like reference numerals refer to like parts in different views or embodiments of the present invention in the drawings.

FIGS. 14A-14F are left side, top, front-right perspective, front, right side and rear views of an embodiment of a snowmaking gun with a snowmaking automation module installed according to the present invention.

DETAILED DESCRIPTION OF THE INVENTION

Figure 1:
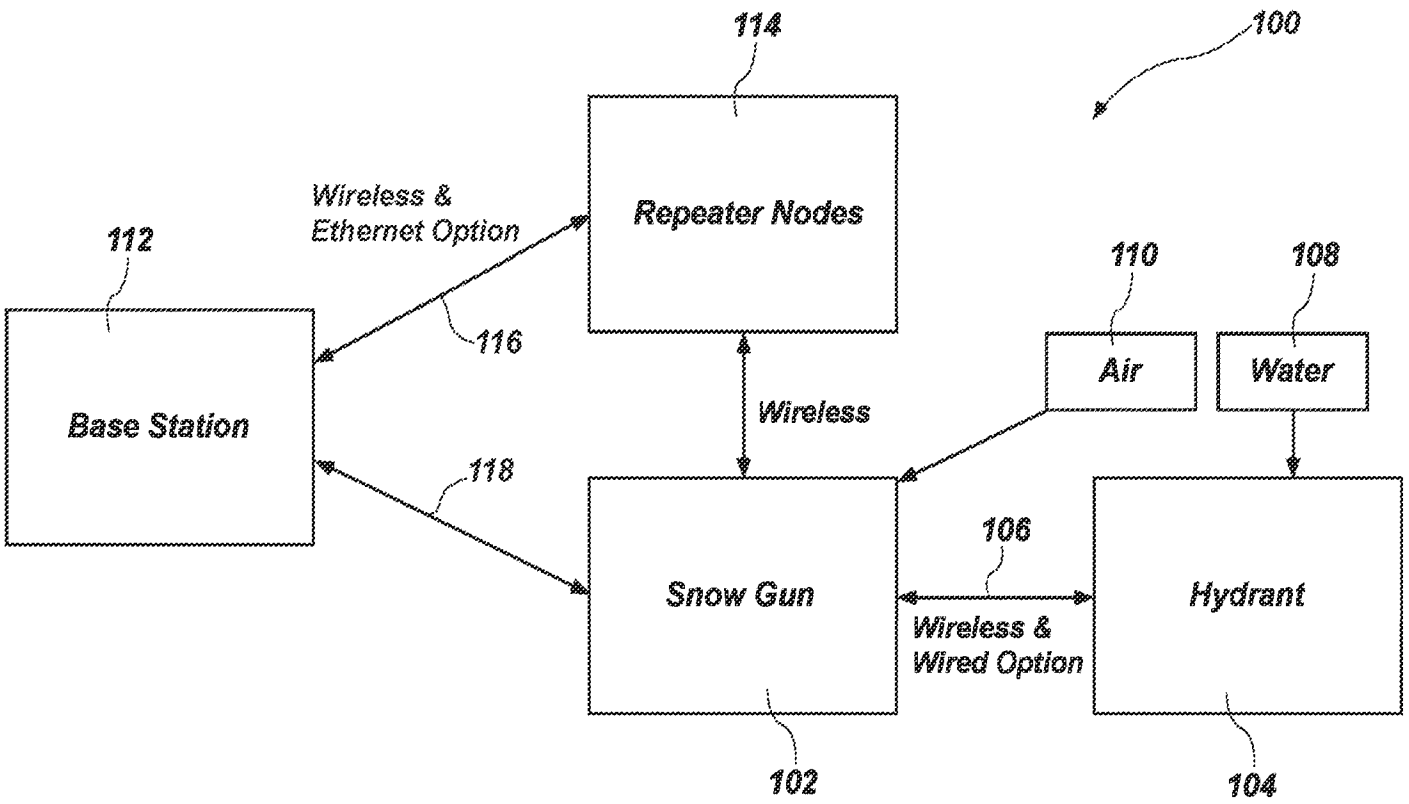
FIG. 1 is a system level block diagram of a snowmaking automation system according to an embodiment of the present invention.

Embodiments of the invention include a snowmaking automation system for use with snowmaking guns and hydrants. Embodiments of the snowmaking automation system described herein may be battery powered, and thus do not require fixed electrical infrastructure, but are designed to use such infrastructure if present on the mountain. The battery life is designed to operate the actuator for 150-200 hours before recharging according to embodiments of a snowmaking automation system of the present invention disclosed herein. This range of time is typically required to complete a batch of snowmaking on a given run at a resort. Some embodiments of the snowmaking automation system are also wireless, and thus, do not require hard-wired communications between base stations and remotely controlled snowmaking guns and hydrants. Another advantageous feature is the anticipated lower cost of operation of the various embodiments of a snowmaking automation systems of the present invention.

Another advantageous feature of the snowmaking automation system is that the actuators employed are modular and can be exchanged between embodiments of the snowmaking gun and embodiments of the hydrant. This level of actuator modularity makes for simpler maintenance, because the actuators are both identical, thus two different actuators, and the associated duplication of inventory, are unnecessary. The embodiments of actuators of the present invention may be swapped out on the mountain and brought back to a workshop for repairs and maintenance. Alternatively, the actuators may be sent back to the manufacturer for repairs eliminating the need for an in-house technician at the resort. The automation modules may be swapped out based on battery charge (need for recharging) or repairs (malfunctions) or scheduled maintenance. For example, damaged automation modules may be swapped out in the field with a replacement. The state and condition of the individual actuators can be tracked in real-time via the snowmaking automation system of the present invention.

According to one embodiment, the actuator on a Snow Logic snowmaking gun is capable of supplying power (24 v) and control signals to a Snow Logic dual auto hydrant, thereby eliminating the need for a radio modem and battery associated with the dual auto hydrant actuator.

Still another advantageous feature of embodiments of the snowmaking automation system of the present invention is that it communicates via a radio network. However, embodiments are also capable of communication by a "hard-wired" link, e.g., Ethernet, optical fiber, twisted pair or any other suitable network cabling if already present at a fixed location on the mountain.

According to another embodiment, each actuator may have an onboard Global Positioning System (GPS) module so that each automation module may be physically tracked by the snowmaking automation system of the present invention, for example by a master control computer. This feature is particularly useful, e.g., in determining the location of a module that needs servicing or recharging.

Yet another advantageous feature of embodiments of the snowmaking automation system employing GPS modules of the present invention is that water pressure sensors may become unnecessary for each snowmaking gun at each individual location. This is because the water pressure may be obtained by measurement from the pump house (original water source) only and then extrapolating pressure by using GPS altitude. This can reduce overall system cost by eliminating water pressure sensors.

Another advantageous feature of embodiments of the snowmaking automation system of the present invention is that there is virtually no limit on the number of adjustments of snowmaking parameters that may be made during a given snowmaking production run. In contrast, manual adjustment by a technician on location at the snowmaking equipment on a mountain typically only occurs 2-5 times per night. By removing the adjustment limitations inherent in manual systems, snowmaking production may be optimized and maximized, while reducing costs. This feature improves snow making production capabilities and snow quality. According to one embodiment, the snowmaking automation system of the present invention is capable of making adjustments to the snowmaking parameters every 15 minutes as ambient conditions change.

Embodiments of the snowmaking automation system of the present invention in combination with a Snow Logic dual auto hydrant provide the capability to automate any conventional type or brand of air water snowmaking gun. This feature is believed to be a first in the industry. Thus, embodiments of the snowmaking automation system of the present invention used in conjunction with a Snow Logic dual auto hydrant can be used to retrofit existing conventional air and water snowmaking systems with automation. This allows for a master control computer (base station) within the snowmaking automation system of the present invention to control different brands and types of snowmaking technology.

It will be apparent that various configurations of the snowmaking automation system of the present invention can be made to suit particular needs of a given resort. For example, the automation may be used to automate the hydrant and leave the gun in a manual configuration, or the reverse, where the gun is automated and the hydrant is manually operated. Of course, the most flexible control occurs when both the gun and hydrant are automated.

Finally, because of the modularity of the snowmaking automation system of the present invention, there are various business models that could be employed with the deployment of such snowmaking equipment, e.g., direct sales to the resort, rental or leasing of the equipment to the resorts. This feature gives ski resorts great flexibility in how they choose to implement snowmaking automation and control over their direct labor costs.

The terms "snowmaking gun" and "snow gun" are used interchangeably herein and are understood to be a device configured to convert water to snow under the appropriate atmospheric conditions. Exemplary snow guns are available from Snow Logic, Inc., Park City, Utah, and may be as described in U.S. Pat. No. 9,170,041 to Dodson. The terms "automated actuator", "snowmaking automation module" and "black box" are also used interchangeably and synonymously herein and are understood to be a device that may be interchangeably attached to either a snowmaking gun or a hydrant through a common actuator interface according to the embodiments of the invention disclosed herein. This interchangeable feature of the automated actuator or snowmaking automation module is believed to be a unique and useful feature that provides greater flexibility in implementing, servicing and maintaining a given snowmaking automation system.

Referring now to FIG. 1, an embodiment of a system level block diagram of a snowmaking automation system 100 is shown, according to present invention. System 100 may include one or more (one shown) snowmaking guns 102 in communication 106 with a hydrant 104. Typically at each location where snowmaking takes place, a snowmaking gun 102 may be physically connected (not shown) to the hydrant 104 via water and optionally compressed air hoses (also not shown). The hydrant 104 is further connected to a pressurized water source 108. A compressed air source 110 may be physically connected with a compressed air hose to the snowmaking gun as shown in the embodiment of FIG. 1. Alternatively, the compressed air source 110 may be connected to valving in the hydrant 104, where the hydrant 104 is a dual auto hydrant, such as the one disclosed in U.S. provisional patent application No. 62/133,289, filed, Mar. 13, 2015, titled: "DUAL AUTO HYDRANT FOR SNOWMAKING EQUIPMENT". In this alternative configuration, the snowmaking gun 102 is physically connected (not shown) to the hydrant 104 via a water hose (also not shown) and compressed air hose (also not shown).

System 100 may further include a base station 112 that is in communication 116 with one or more (one shown) repeater nodes 114 and is also in communication 118 with the one or more snowmaking guns 102. The communications 116 and 118 may be wireless or wired depending on the particular embodiment. Of course, the wireless communication (106, 116, 118) embodiments offer the greatest flexibility in terms of locating the gun 102 and hydrant 104 on a given mountain location (not shown).

The repeater nodes 114 are used to provide wireless connectivity between the base station 112 and each snowmaking gun 102 and hydrant 104 in the varied topography that one might encounter on a mountain resort ski slope. Each repeater node 114 operates much like a cellphone tower to provide geographic coverage of the wireless network. The repeater nodes 114 may be located anywhere on the mountain and used to provide full coverage of terrain that is subject to snowmaking. The repeater nodes 114 may operate at any suitable radio frequency (RF) or band of frequencies and use any suitable communications protocol. The repeater nodes 114 may be portable or fixed in physical location according to other embodiments of the present invention.

Another advantageous feature of embodiments of the snowmaking automation system of the present invention is that the RF repeater nodes 114 may be employed to cover any mountainous terrain with a wireless network for use by the snowmaking automation system. Dead spots and optimal placement of repeater nodes 114 may be determined by any suitable RF signal detector (not shown). Such an RF signal detector may be designed and used to audit the locations of snowmaking equipment, e.g., snowmaking gun 102 and hydrant 104, to easily determine dead spots (no wireless network signal) and preferred placement of portable RF repeater stations for complete network coverage on the mountain. For example, the RF signal detector may be backpack mounted or hand carried for skiing or snowshoeing over ski trails to snowmaking locations, or otherwise mounted on a vehicle, snowmobile or snow cat to perform such a network audit as well as for initial repeater node 114 placement.

Figure 2:
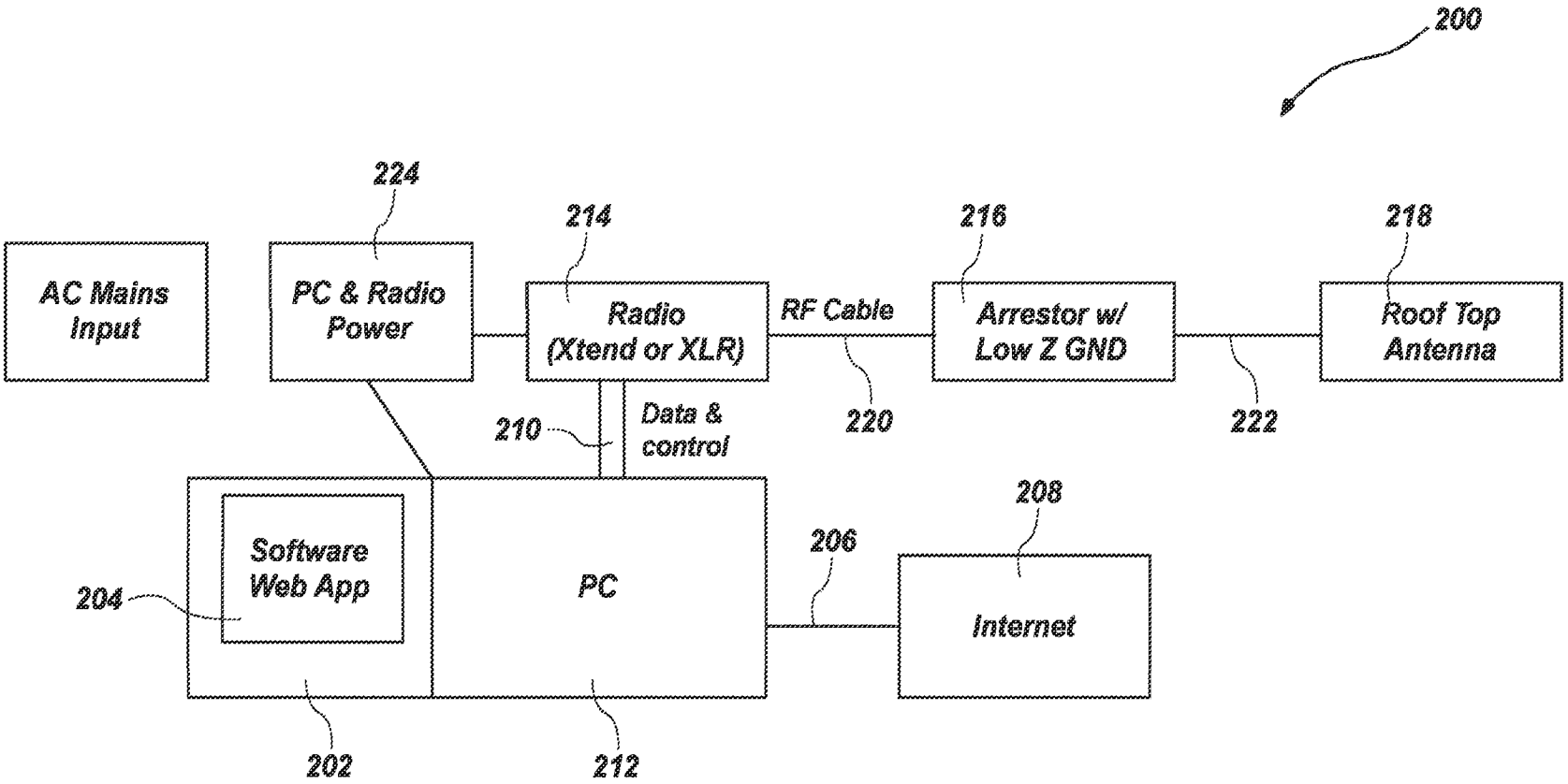
FIG. 2 is a block diagram of a base station according to an embodiment of the present invention.

Referring now to FIG. 2, a block diagram of a particular embodiment of a base station 200 is shown, according to the present invention. The base station 200 may include a general purpose computer or personal computer (PC) 212, having memory 202 for storing software, namely a web application 204 that is configured and programmed to control and operate the snowmaking automation system 100 (FIG. 1) of the present invention. Computer 212 may have a connection 206 to the Internet 208. The connection 206 may be a wireless or wired connection using routers, wireless or otherwise, using hardware that is well known to those of ordinary skill in the art. The web application 204 may be used at the base station 200 to remotely monitor and control all aspects of snowmaking production. It is further contemplated that a suitable mobile application (app) could provide mobile remote control of snowmaking production from a mobile smartphone in much the same way a computer 212 would control production.

Computer 212 may further be connected 210 to a radio 214 which may be further connected to an antenna 218 via an optional arrestor 216 through suitable RF cabling 220, 222. Arrestor 216 provides electrical surge protection from lightning strikes for example. The radio 214 is used to wirelessly connect to each of the snowmaking guns 102 (see FIG. 1) and hydrants 104 (see FIG. 1) that are located on the mountain resort via the repeater nodes 114 (see FIG. 1) if necessary. Power for the computer 212, radio 214 and any of the other components (Internet modem or router neither shown, computer peripherals, i.e., monitor, printer, etc., also not shown) that require power, may be sourced from the building (not shown) or location where the base station 200 is located, e.g., the power block 224 shown in FIG. 2.

Figure 3:
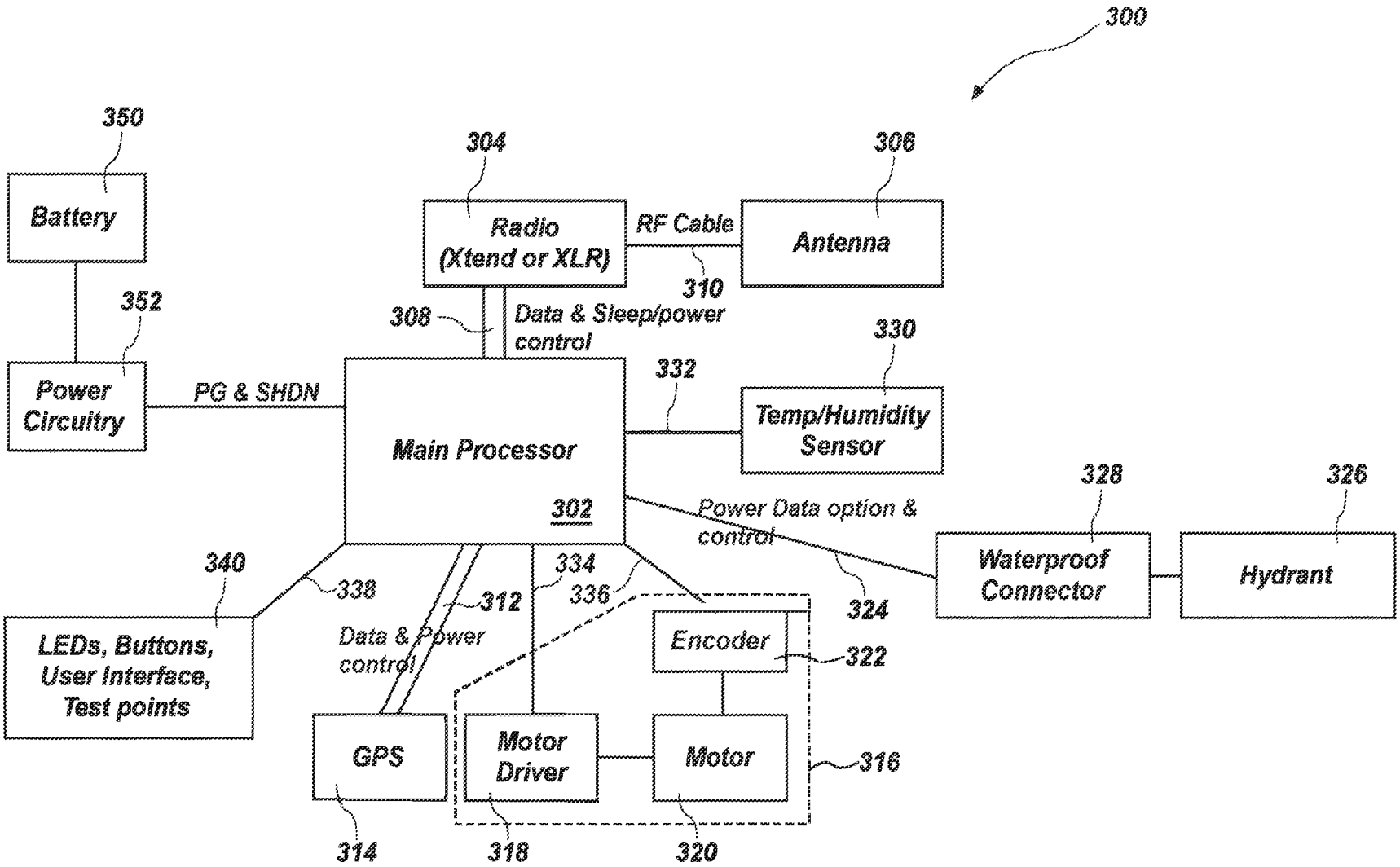
FIG. 3 is a block diagram of a snowmaking gun automation module according to an embodiment of the present invention.

Referring to FIG. 3, a block diagram of a snowmaking gun automation module 300 is shown, according to an embodiment of the present invention. Module 300 may include a processor 302 for controlling module 300. Processor 302 may be in communication 308 with a radio 304. Radio 304 may be connected 310 to an antenna 306. Connection 310 may comprise an RF cable. Processor 302 may be in communication 312 with a GPS module 314. The GPS module 314 provides accurate location information relating to the snowmaking gun 102 (see FIG. 1) that it is attached to.

Module 300 may further include an actuator, see dashed line enclosure 316, that is physically connected to the snowmaking gun 102 (not shown, but see FIG. 1). Actuator 316 is in communication 334, 336 with the processor 302. The actuator 316 drives the mechanical valving within the snowmaking gun 102 under processor 302 control. The actuator 316 may include a motor driver 318, which is in communication with a motor 320, which is in turn in communication with an encoder 322.

Processor 302 may further be in communication 324 with a hydrant 326. Communication 324 may be wireless or hard-wired according to various embodiments of the present invention. According to a hard-wired communication 324 embodiment, power, optional data and control signals may be transmitted between processor 302 and hydrant 326 via a waterproof connector 328. Processor 302 may further be in communication 332 with a temperature and humidity sensor 330. The temperature and humidity information from sensor 330 may be transmitted back to the base station 112, 200 for adjusting snowmaking parameters of the guns 102 and hydrant 104.

Processor 302 may further be in communication 338 with a user interface 340. The user interface 340 may be a dedicated weather-proofed panel configured with LED indicators, buttons, switches, test points and anything else used to control the module 300. The buttons may be used to manually open, or advance, the valve, manually close the valve, test the communications link, and to obtain battery status. LED indicators may indicate gun valve positioning (1-4 for a 4-step gun), communications signal connection and signal strength, GPS communications, etc. Alternatively, user interface 340 may be a touch panel configured appropriately to manually control the snowmaking gun 102, according to another embodiment. The configuring and programming of a touch panel is within the knowledge of one of ordinary skill in the art, and thus, will not be further elaborated herein.

A particularly useful and novel feature of one embodiment of module 300 is that it can be battery operated for between 150-200 hours on a single charge. As shown in FIG. 3, processor 302 may be connected to power circuitry 352 which forms an interface to battery 350. Power circuitry 352 converts the stored battery power for use by the processor 302, actuator 316 and radio 304 and any other component that needs power. Battery 350 may be of any suitable battery technology. The presently preferred battery technology for module 300 is lithium iron battery technology because of its ability to operate in extreme cold weather conditions.

Figure 4:
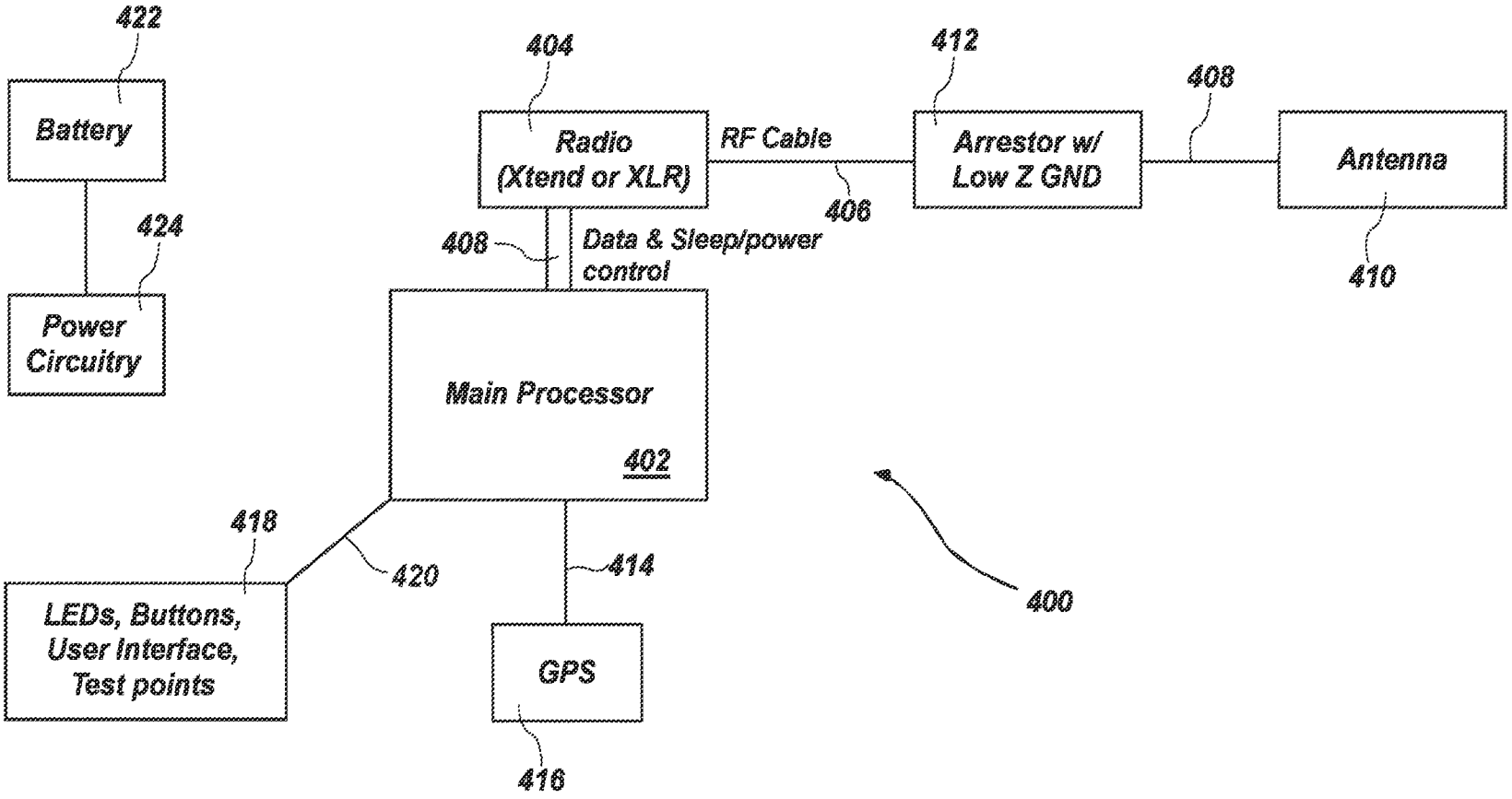
FIG. 4 is a block diagram of a repeater according to an embodiment of the present invention.

Referring now to FIG. 4, a block diagram of a repeater 400 is shown, according to an embodiment of the present invention. Repeater 400 may include a processor 402 in communication 408 with a radio 404. Radio 404 may be in communication 406, 408 with antenna 410 via an arrestor 412 for lightening and electrical surge protection. Processor 402 may further be in communication 414 with a GPS module 416.

Processor 402 may be further connected 420 to a user interface 418. The user interface 418 may be a dedicated weather-proofed panel configured with LED indicators, buttons, switches, test points and anything else used to manually control the repeater 400. For example buttons may include a button for testing the communication link. LED indicators may include communications OK, power indicator, RX LED and TX LED for indications regarding the receiving and transmission of data. Alternatively, user interface 418 may be a touch panel configured appropriately to control repeater 400. Again the configuring and programming of a touch panel is within the knowledge of one of ordinary skill in the art, and thus, will not be further elaborated herein.

Power to drive the repeater 400 may come from power mains 422 available at the location on the hill where the repeater 400 is installed. Alternatively, power may be supplied by a battery (not shown), according to another embodiment. Thus, repeater 400 may also be located anywhere and moved if necessary. Power circuitry 424 may be used to condition the power from the power mains 422, or battery (not shown) prior to distribution to the processor 402, radio 404, and anything else that needs powering within repeater 400.

Figure 5:
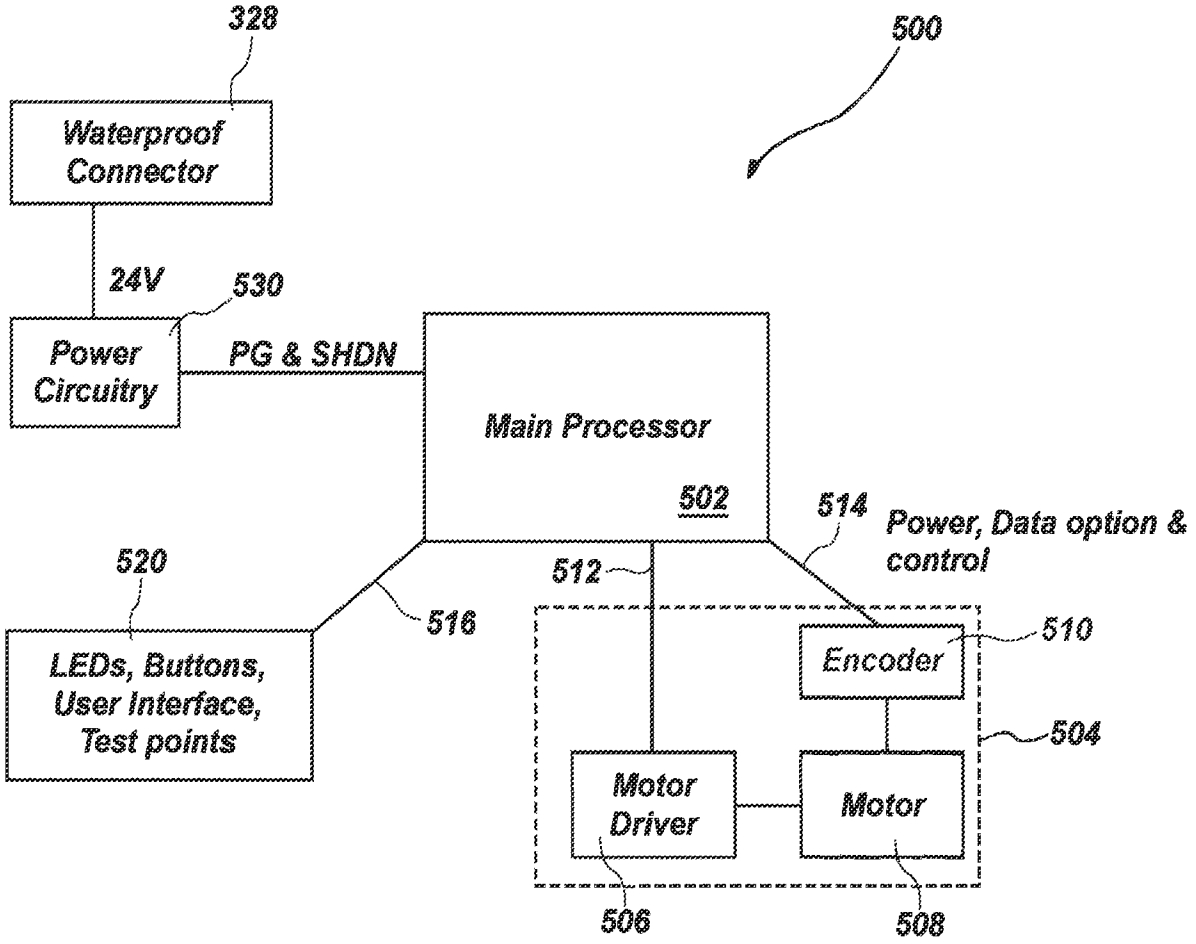
FIG. 5 is a block diagram of a hydrant automation module according to an embodiment of the present invention.

Referring now to FIG. 5 a block diagram of a hydrant automation module 500 is shown, according to an embodiment of the present invention. Module 500 may further include an actuator, see dashed line box shown at 504. Actuator 504 is physically connected to the hydrant 104 (not shown, but see FIG. 1). Actuator 504 is in communication 512, 514 with the processor 502. The actuator 504 drives the mechanical valving within the hydrant 104 under processor 502 control. The actuator 504 may include a motor driver 506, which is in communication with a motor 508, which is in turn in communication with an encoder 510. Processor 502 may further be in communication 516 with a user interface 520 similar to the user interfaces 340 and 418 provided for module 300 and repeater 400, respectively.

According to the embodiment of hydrant automation module 500 shown in FIG. 5, the module 500 obtains power from module 300 via waterproof connector 328. Of course, the embodiment of module 500 illustrated is a hard-wired configuration. A wireless embodiment of module 500 would be similar to the module 300 shown in FIG. 3.

Figure 6A:
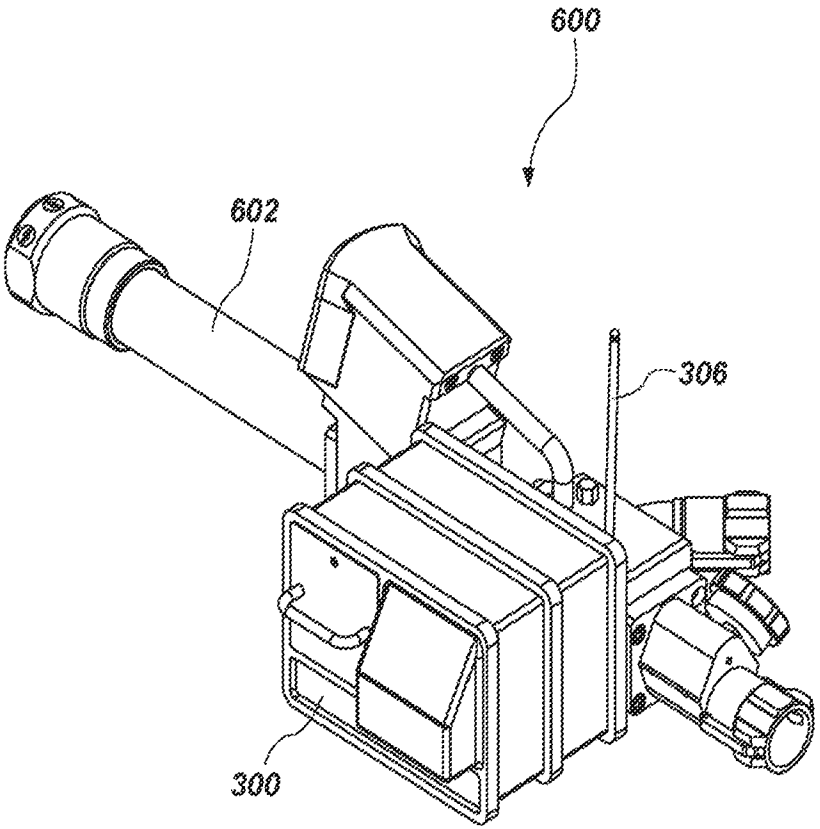
FIGS. 6A-6C are perspective, front and top views, respectively, of a snowmaking gun automation module attached to a snowmaking gun according to an embodiment of the present invention.
Figure 6C:
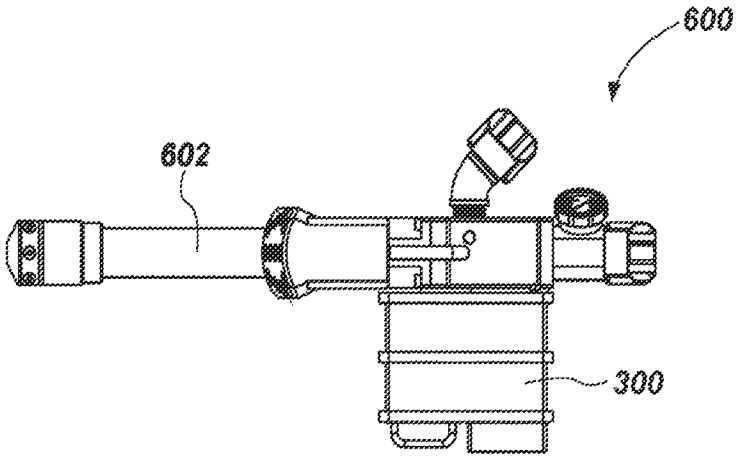
Figure 6B:
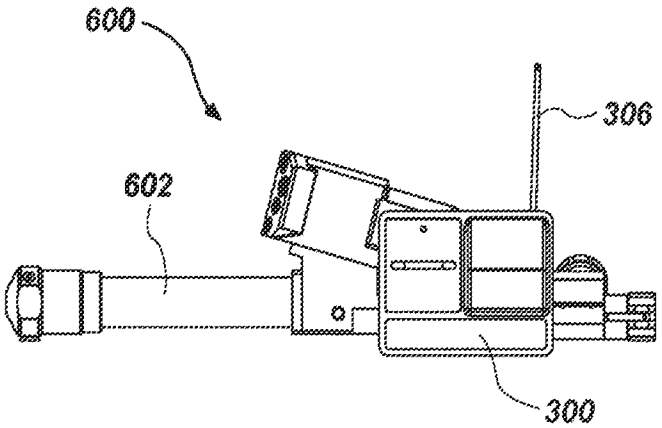
Figure 7A:
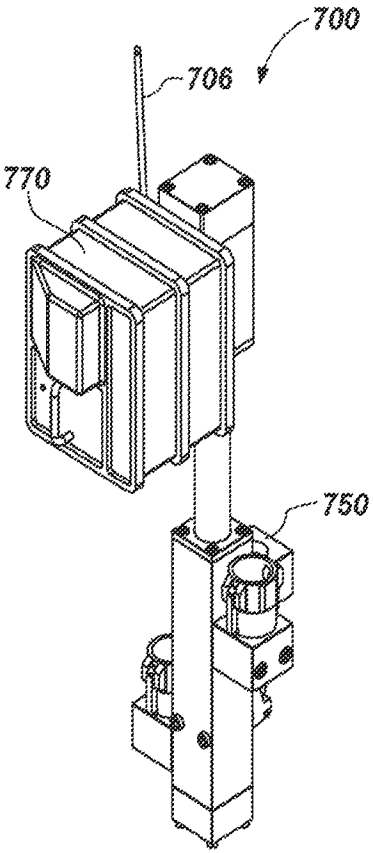
FIGS. 7A-7E are perspective, bottom, front, top and left side views, respectively, of a hydrant automation module attached to a dual auto hydrant according to an embodiment of the present invention.
Figure 7D:
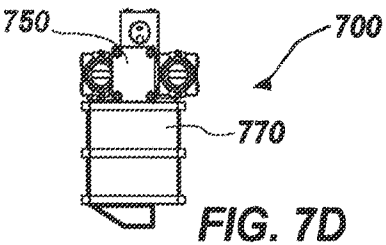
Figure 7C:
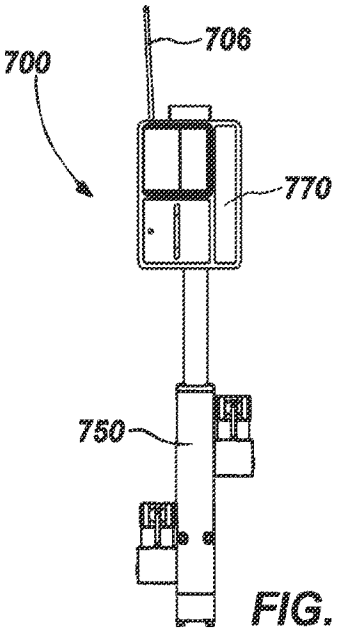
Figure 7B:
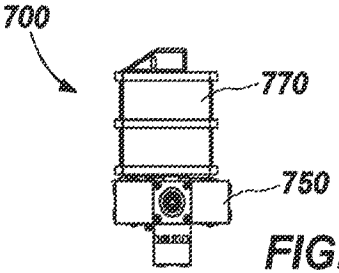
Figure 7E:
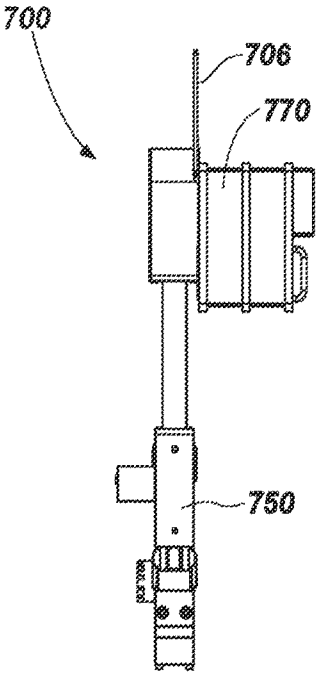

FIGS. 6A-6C are perspective, front and top views, respectively, of an automated snowmaking gun 600. The automated snowmaking gun 600 may include a snowmaking gun automation module 300 attached to a snowmaking gun 602 according to an embodiment of the present invention. The actuator 316 within module 300 is coupled to the gun 600 and can remotely control the gun 600 from a base station 200 (not shown, but see FIG. 200). The module 300 is shown with an externally mounted antenna 306 (FIGS. 6A and 6B).

FIGS. 7A-7E are perspective, bottom, front, top and left side views, respectively, of an automated dual auto hydrant 700. The automated dual auto hydrant 700 may include a wireless hydrant automation module 770 attached to a dual auto hydrant 750 according to an embodiment of the present invention. The wireless hydrant automation module 770 is essentially identical to the snowmaking gun automation module 300 discussed herein, but configured to drive the dual auto hydrant 750. A presently preferred embodiment of a dual auto hydrant 750 may be as described in co-pending U.S. nonprovisional patent application Ser. No. 15/069,945, filed, Mar. 14, 2016, titled: "DUAL AUTO HYDRANT FOR SNOWMAKING EQUIPMENT AND METHOD OF USING SAME", the contents of which are incorporated by reference for all purposes as if fully set forth herein. Note that module 770 may include an externally mounted antenna 706.

Figure 8:
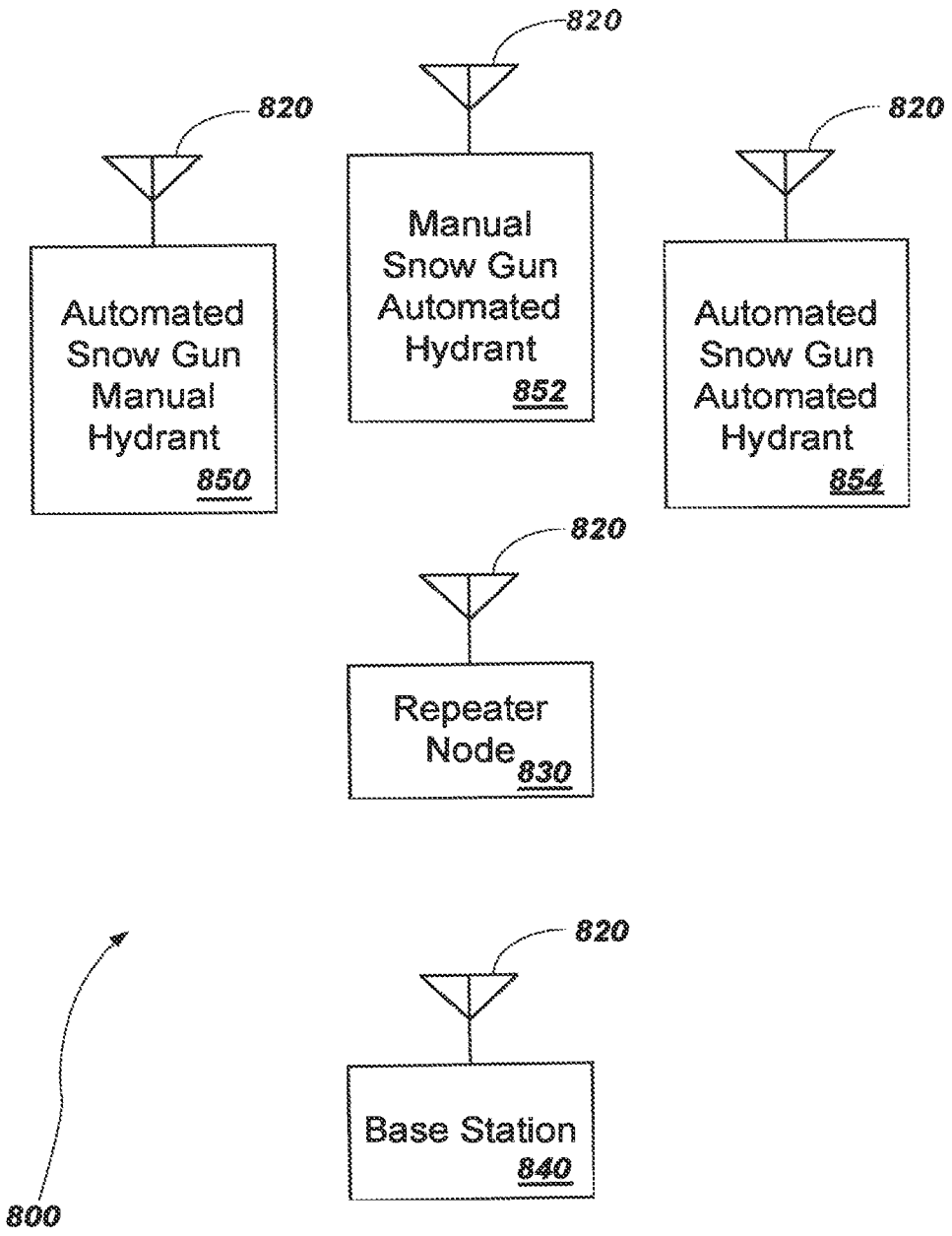
FIG. 8 is a block diagram of an embodiment of an automated snowmaking system according to the present invention.

FIG. 8 is a block diagram of an embodiment of an automated snowmaking system 800 according to the present invention. System 800 may include a plurality of snow guns with hydrants 850, 852 and 854 located at select locations on a ski slope (not shown). Each snow gun with hydrant 850, 852 and 854 may include an antenna 820 for wireless communication to a base station 840 which in turn has its own antenna 820. Depending on the range of the wireless communications technology employed, system 800 may further include one or more repeater nodes 830 with an antenna 820 for extending the range of communications to each snow gun with hydrant 850, 852 and 854, regardless of how far from the base station 840 they may be.

Figure 9:
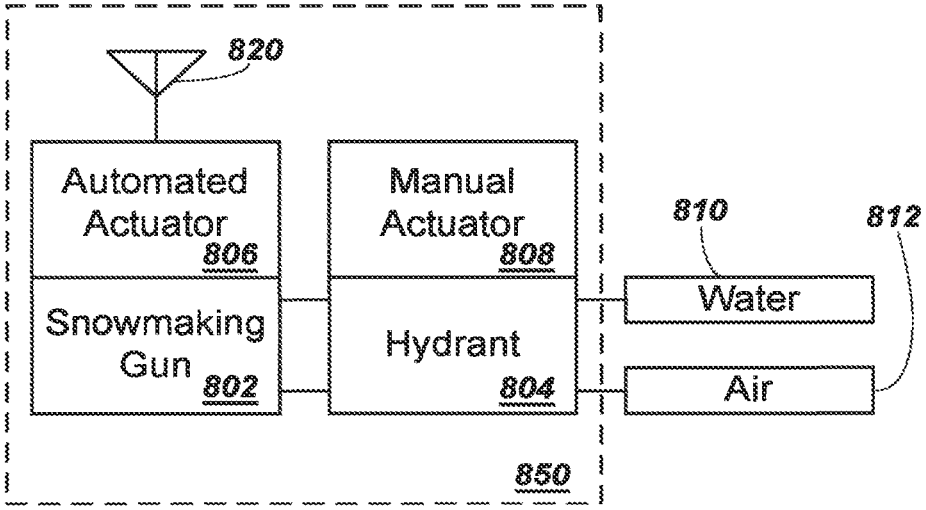
FIG. 9 is a block diagram of an embodiment of an automated snow gun with manual hydrant according to the present invention.
Figure 10:
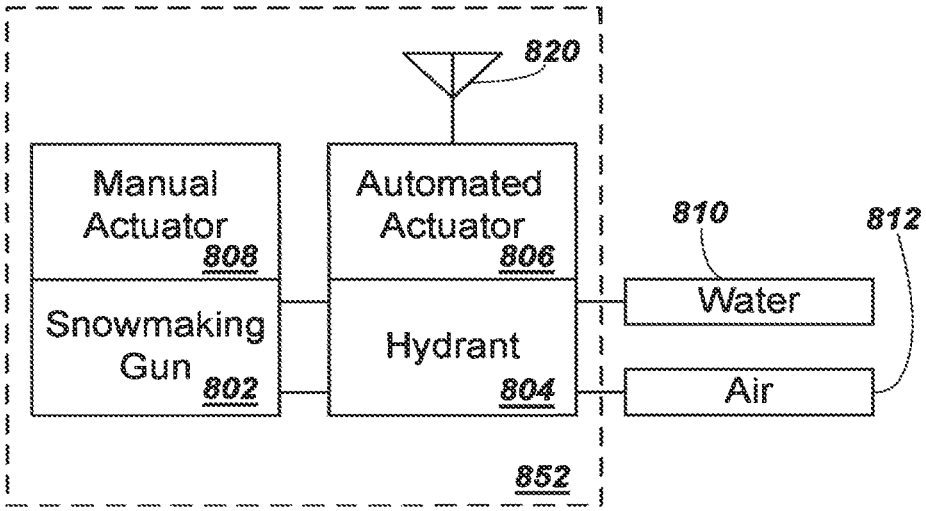
FIG. 10 is a block diagram of an embodiment of a manual snow gun with automated hydrant according to the present invention.
Figure 11:
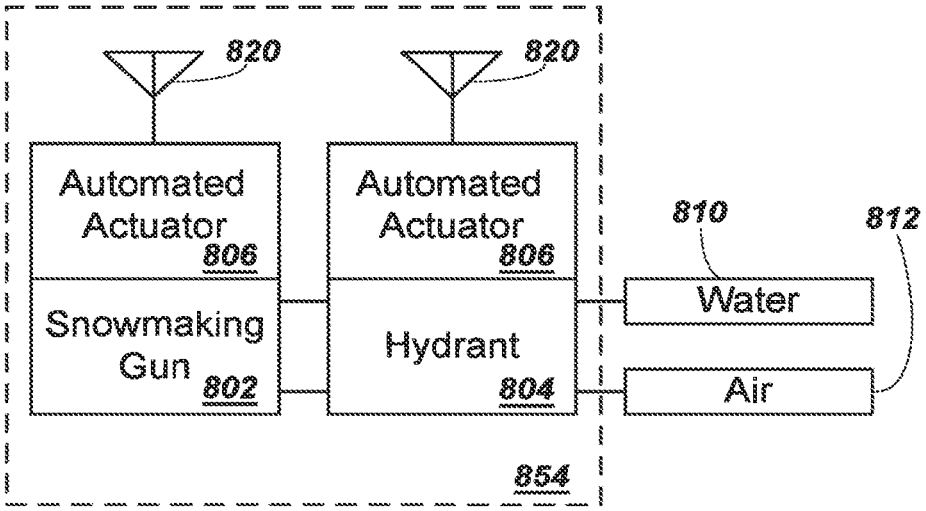
FIG. 11 is a block diagram of an embodiment of an automated snow gun with automated hydrant according to the present invention.

The snow guns with hydrants 850, 852 and 854, may be configured in three ways. The first configuration is an automated snow gun with manual hydrant 850. In this first configuration, the snow gun can be controlled remotely from the base station 840, but the hydrant remains manually operated. The second configuration is a manual snow gun with automated hydrant 852. In this second configuration, the snow gun requires manual operation, but the hydrant can be controlled remotely from the base station 840. The third configuration is a fully automated snow gun with automated hydrant 854. In this third configuration both the snow gun and the hydrant can be remotely controlled from the base station 840. FIGS. 9-11 provide additional detail and description of the snow guns with hydrants 850, 852 and 854.

FIG. 9 is a block diagram of an embodiment of an automated snow gun with manual hydrant 850 according to the present invention. The first configuration of an automated snow gun with manual hydrant 850 may include a snowmaking gun 802 with an automated actuator 806 installed. For example and not by way of limitation, snowmaking gun 802 may be as described in U.S. Pat. No. 9,170,041 to Dodson, the contents of which are incorporated by reference for all purposes as if fully set forth herein. The automated actuator 806 may include an antenna 820 for wireless communication with a base station 840 (see FIG. 8) directly, or indirectly through a repeater node 830.

The first configuration of an automated snow gun with manual hydrant 850 may further include a hydrant 804 having a manual actuator 808. For example and not by way of limitation, hydrant 804 may be a dual auto hydrant as described in co-pending U.S. nonprovisional patent application Ser. No. 15/069,945, filed, Mar. 14, 2016, titled: "DUAL AUTO HYDRANT FOR SNOWMAKING EQUIPMENT AND METHOD OF USING SAME", the contents of which are incorporated by reference for all purposes as if fully set forth herein. For example and not by way of limitation, the manual actuator 808 contemplated herein may be a hydrant control lever, such as described in application Ser. No. 15/069,945 at reference number 174, which controls a rack and pinion mechanism 302 within the dual auto hydrant 100. However, it will be understood that any hydrant from any manufacturer could be adapted for use with the automated actuators 806 described herein.

The first configuration of an automated snow gun with manual hydrant 850 may further include a pressurized water source 810 and a compressed air source 812, both feeding the hydrant 804. An exemplary pressurized water source 810 and compressed air source 812 have both been described in detail above. In this first configuration of an automated snow gun with manual hydrant 850, both the water source 810 and air source 812 are manually controlled by the hydrant 804, which in turn supplies the snowmaking gun 802.

FIG. 10 is a block diagram of an embodiment of a manual snow gun with automated hydrant 852 according to the present invention. The second configuration of a manual snow gun with automated hydrant 852 may include a snowmaking gun 802 with a manual actuator 808 installed. For example and not by way of limitation, snowmaking gun 802 may be as described in U.S. Pat. No. 9,170,041 to Dodson, with a manual actuator 808 shown as a pinion handle 116 (U.S. Pat. No. 9,170,041 to Dodson).

The second configuration of a manual snow gun with automated hydrant 852 may further include a hydrant 804 with an automated actuator 806 installed. The automated actuator 806 may include an antenna 820 for wireless communication with a base station 840 (see FIG. 8) directly, or indirectly through a repeater node 830. The second configuration of a manual snow gun with automated hydrant 852 may further include a pressurized water source 810 and a compressed air source 812 feeding into hydrant 804. In this second configuration a manual snow gun with automated hydrant 852, both the water source 810 and air source 812 may be remotely controlled by the hydrant 804, which in turn supplies the snowmaking gun 802.

FIG. 11 is a block diagram of an embodiment of an automated snow gun with automated hydrant 854 according to the present invention. The third configuration of an automated snow gun with automated hydrant 854 may include a snowmaking gun 802 with an automated actuator 806 installed. The third configuration of an automated snow gun with automated hydrant 854 may further include a hydrant 804 with an automated actuator 806 installed. In this third configuration, the water source 810 and air source 812 feed the hydrant 804 which are remotely controlled to selectively pass through to the snowmaking gun 802 which in turn is remotely controlled to generate snow in the appropriate atmospheric conditions. This third configuration of an automated snow gun with automated hydrant 854 is believed to be the most labor cost effective as it does not need manual attendance from an operator at its actual location for long periods of time.

Figure 12:
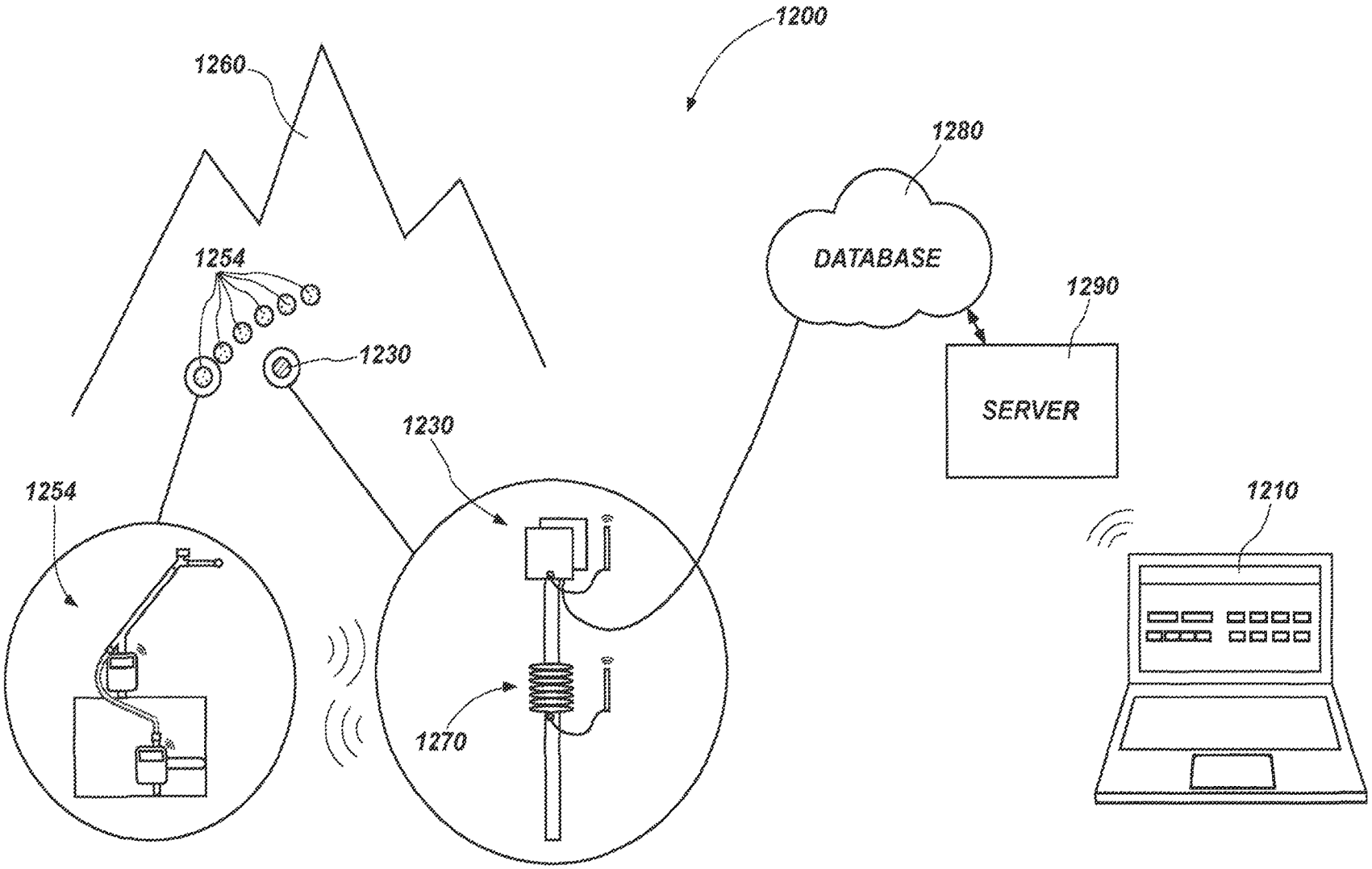
FIG. 12 is a diagram of another embodiment of an automated snowmaking system according to the present invention.

FIG. 12 is a diagram of another embodiment of an automated snowmaking system 1200 according to the present invention. A plurality (six shown) of automated snow gun and automated hydrants 1254 are located at designated positions on a mountain 1260 where snowmaking is desired. One or more repeater nodes 1230 (only one shown) may be strategically located on the mountain 1260 to provide a wireless radio connection to all of the automated snow gun and automated hydrants 1254. One or more weather stations 1270 (only one shown) may be placed on the mountain at or near locations where snowmaking is desired. Such weather stations 1270 may include a variety of sensors for temperature, humidity, wind speed, barometric pressure and the like that are useful for determining atmospheric conditions for snowmaking. The weather stations 1270 may also communicate wirelessly with the repeater nodes 1230 to provide this real time weather information for use in fine tuning the snowmaking process and determining whether conditions are sufficient for making snow in the first place.

Data of interest, e.g., water flow rate, water pressure, compressed air pressure, temperature, operational duration, battery life, sensed at the snowmaking automation module may be gathered from each of the various snowmaking automation modules attached to the snowmaking guns and hydrants 1254 and transmitted back to a database 1280 for use by a server 1290 which may store a computer program (not shown) for controlling the snowmaking automation system 1200, according to various embodiments of the present invention. A user (not shown) would interact with the snowmaking automation system 1200 using a computer 1210 with access to the server 1290 through a direct network connection or through the Internet if the database 1280 and/or server 1290 are located in the cloud, according to various embodiments of the present invention. The computer 1210 may or may not be located in a base station (840, FIG. 8), according to embodiments of the present invention.

Figure 13C:
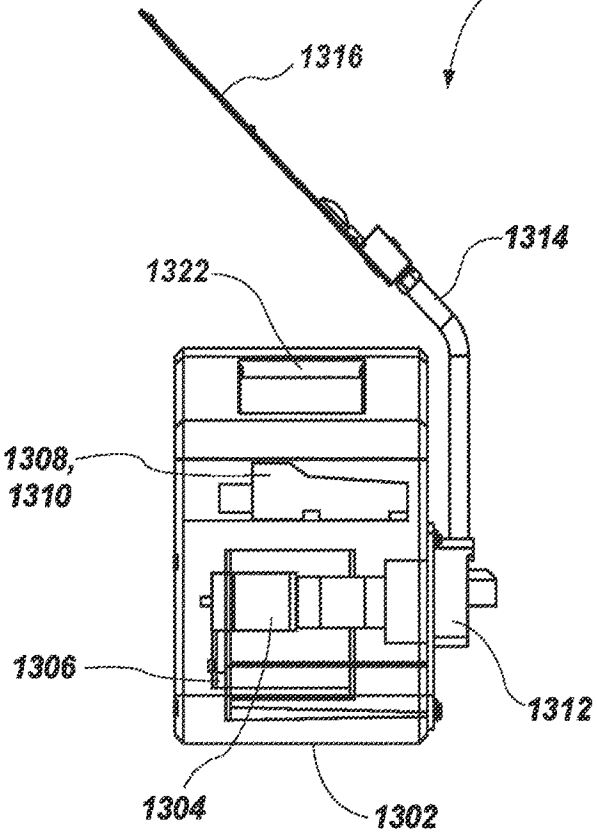
FIGS. 13A-13C are left side, front and right side views of an embodiment of a snowmaking automation module according to the present invention.
Figure 13B:
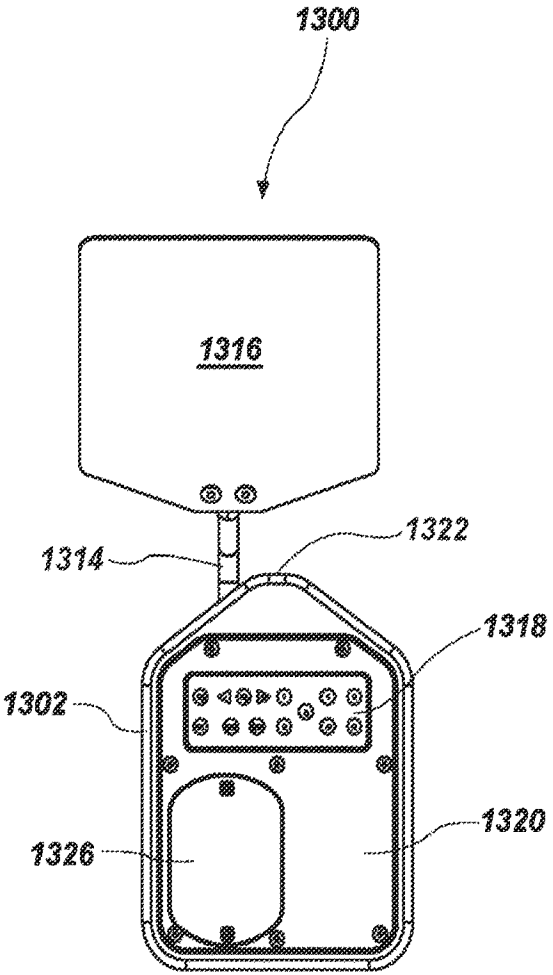
Figure 13A:
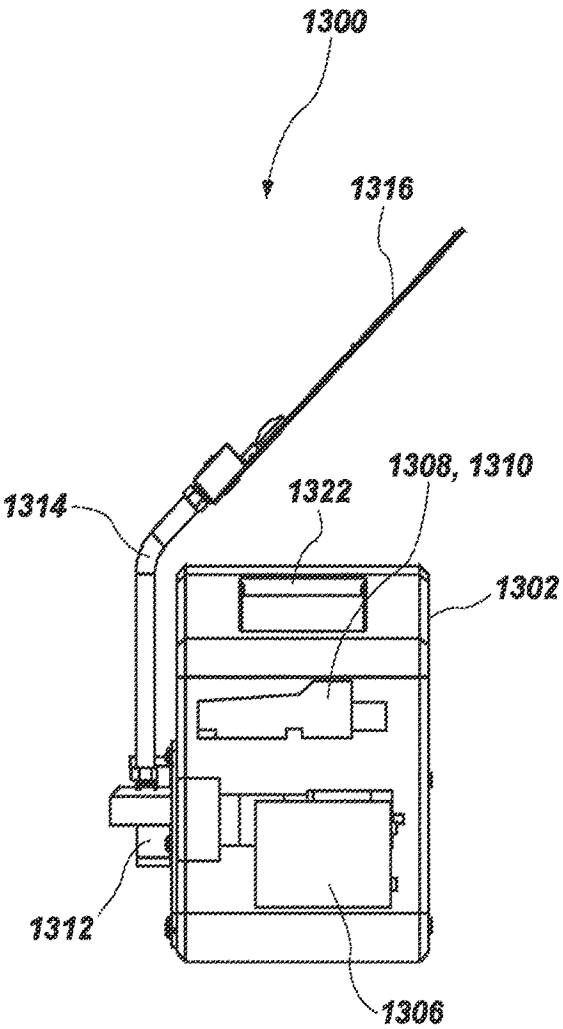
Figure 15C:
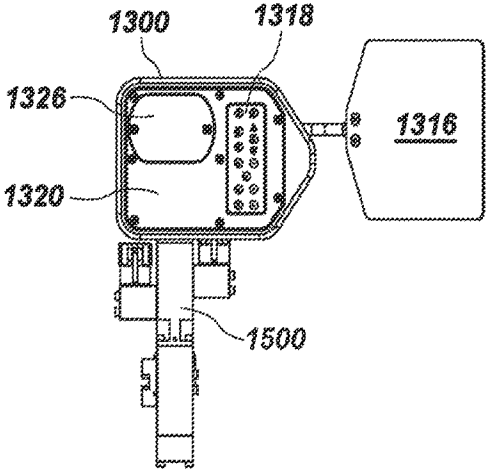
FIGS. 15A-15F are rear perspective, top, front, right side, rear and left-side view of an embodiment of a hydrant with a snowmaking automation module installed according to the present invention.
Figure 15F:
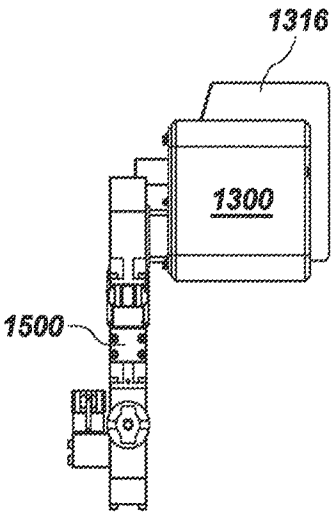
Figure 15B:
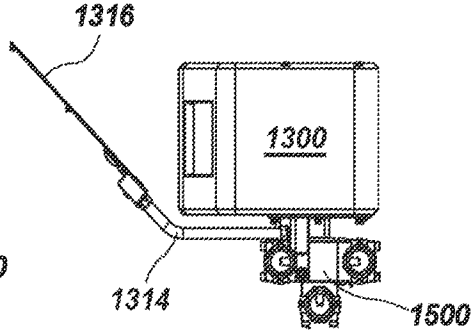
Figure 15E:
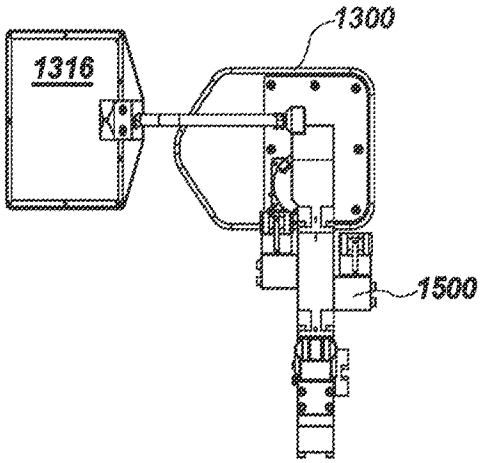
Figure 15A:
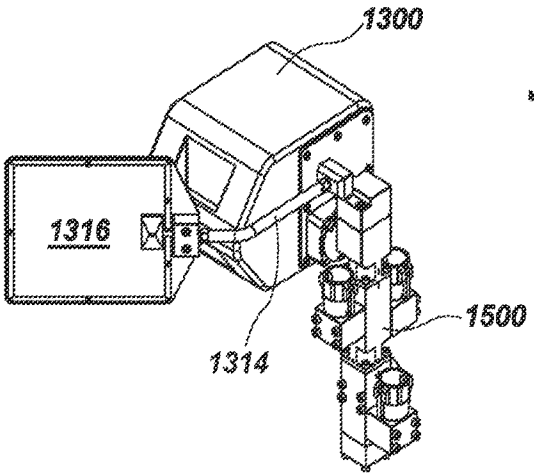
Figure 15D:
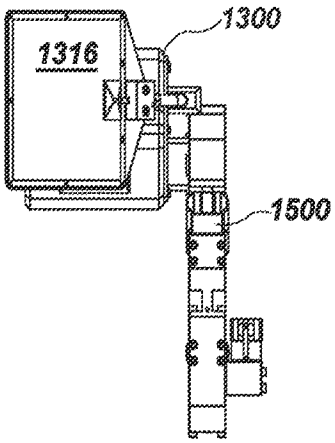

FIGS. 13A-13C are left side, front and right side views of an embodiment of a snowmaking automation module 1300 according to the present invention. Module 1300 may include a housing 1302 for holding a gear motor 1304, battery 1306 (shown in transparent view, FIGS. 13A and 13C), radio modem 1308 (shown in transparent view, FIGS. 13A and 13C) and GPS module 1310 (also shown in transparent view, FIGS. 13A and 13C). Housing 1302 may further include an actuator interface 1312 that is coupled to the gear motor 1304. The actuator interface 1312 allows the snowmaking automation module 1300 to replace a user manually turning a handle or lever used to actuate the snow gun or hydrant.

Housing 1302 may further include a control panel 1318 and a battery box cover 1326 mounted along a front face panel 1320 of the housing 1302 and a handle 1322. Control panel 1320 may be used to manually configure the snowmaking automation module 1300 for automatic operation based on the snowmaking gun or hydrant to which it is attached. The control panel 1320 may also be used to manually operate the gun or hydrant to which it is attached. The handle 1322 may be used to remove, transport and install the snowmaking automation module 1300 to and from snowmaking sites. Module 1300 may further include a flexible pipe 1314 which supports a solar panel 1316. The solar panel 1316 provides passive recharging of the battery 1306. Flexible pipe 1314 further houses electrical conduit from the solar panel 1316 to the battery. The embodiment of a radio antenna 1324 coupled to the radio modem 1308 is located within the housing 1302 as shown in FIG. 13C. However, it will be understood that an antenna for radio communications could be located external to the housing 1302 in other embodiments of the present invention.

FIGS. 14A-14F are left side, top, front-right perspective, front, right side and rear views of an embodiment of a snowmaking gun 1400 with a snowmaking automation module 1300 installed according to the present invention. Note that the snowmaking gun 1400 is not shown connected to pressurized water or compressed air sources that would be needed for snowmaking, in order to simplify illustrating the different views.

FIGS. 15A-15F are rear perspective, top, front, right side, rear and left-side view of an embodiment of a hydrant 1500 with a snowmaking automation module 1300 installed according to the present invention. Note that the hydrant 1500 is not shown connected to pressurized water or compressed air sources for ease of illustrating the different views.

It will be understood that various combinations of hardware, firmware and software may be used to implement the command, control, raw data storage (database) and control program storage and execution (server) for controlling and monitoring all of the snowmaking automation modules 1300 or "black boxes" and repeater nodes 1230 dispersed about a mountainside at a ski resort, as well as, databases, servers and computers shown, for example in FIG. 12. According to one embodiment, the software or code resident in the black boxes 1300, may be firmware that sends status of the current state of the snow gun or hydrant to which it is attached and receives commands via a repeater node 1230. According to one embodiment, the software in the black box is coded in the C language.

According to another embodiment, the computer code in a repeater node 1230 receives statuses from the black boxes 1300 and from transmitting weather stations 1270 and may convert bytes of data into JavaScript Object Notation (JSON) to transmit to the database 1280 for storage. The computer code in the repeater nodes may also be configured for receiving JSON coded data from the database 1280 and translating it into bytes sent to the black boxes 1300. According to one embodiment, the software code of the repeater node 1230 and its radio modem 1308 may be coded in the Python scripting language.

According to still another embodiment, the computer code used in the database 1280 may be used to store data received from the repeater node 1230 and from the web interface input by a user of the system. According to an embodiment, the software code of the database 1280 may be coded in the Python scripting language and JavaScript and the database itself may be implemented using RethinkDB™, 32-bit. RethinkDB™ is an open-source, scalable JSON database used for real time web applications available at https://rethinkdb.com. However, it will be understood that other databases could be used to implement database 1280 as described herein.

According to yet another embodiment, the computer code in the server 1290 may be used to process data from the database for sending to the web interface and vice versa. According to a particular embodiment, the server 1290 may be implemented in Node.js™ available at https://nodejes.org. Node.js™ is an open-source, cross-platform runtime environment for developing server-side Web applications. According to one embodiment, JavaScript is the programming language used to implement modules within the Node.js development platform.

According to another embodiment, the web interface viewed in a browser on computer 1210 provides the user with an interface to control the black boxes 1300 from any computer/or smartphone with internet access. According to a particular embodiment, the software code used to implement the web interface may be JavaScript and HyperText Markup Language (HTML).

Having described a number of embodiments of the inventive snowmaking automation system and its associated snowmaking automation modules with reference to the drawing figures, additional more general embodiments of the system and modules will now be described.

An embodiment of a snowmaking automation system for remotely controlling the generation of snow is disclosed. The system may include a hydrant for selectively receiving and delivering pressurized water and compressed air. The system may further include a snowmaking gun coupled to the hydrant to selectively receive the pressurized water and the compressed air. The system may further include at least one automation module coupled to the hydrant or the snowmaking gun, each of the at least one automation modules having a means for communication and a motor for actuating the snowmaking gun or the hydrant to selectively generate snow using the water and the air. The system may further include a base station in communication with the at least one automation module, the base station configured to provide a user control of the at least one automation module and thereby remotely control generation of the snow.

According to another embodiment of the snowmaking automation system, the at least one automation module may include a first automation module coupled to the hydrant and a second automation module coupled to the snowmaking gun. According to yet another embodiment of the snowmaking automation system, the means for communication may be wireless radio communication, hardwired network communication, or optical fiber communication. According to still another embodiment, the snowmaking automation system may further include at least one repeater node linking wireless communication between the base station and the at least one automation module. According to still another embodiment, the snowmaking automation system may further include a weather station in communication with the repeater node. The weather station may be configured for sensing and transmitting atmospheric weather conditions back to a database for use by a server.

According to another embodiment, the snowmaking automation system may further include a database in communication with the at least one automation module for storing data gathered from the at least one automation module. According to another embodiment, the snowmaking automation system may further include a server in communication with the at least one automation module and the database. The server may be configured for storing and running a computer software program configured for remotely interacting with and controlling the at least one automation module and the database according to one embodiment. According to another embodiment, the snowmaking automation system may further include a computer with a user interface or web interface in communication with the server, the database and the at least one automation module. The computer with the user interface may be configured to remotely interact with and control the at least one automation module according to one embodiment.

According to a particular embodiment of a snowmaking automation system, the at least one automation module further include a housing with an actuator interface for attachment to a snowmaking gun or a hydrant. The at least one automation module may further include a gear motor with encoder mounted inside the housing and coupled to the actuator interface, the gear motor configured to selectively drive a snowmaking gun or a hydrant according to this embodiment. The at least one automation module may further include a radio modem and antenna mounted inside the housing. The at least one automation module may further include a battery mounted inside the housing, the battery coupled to, and configure for powering, the gear motor and the radio modem.

An embodiment of a snowmaking automation module is disclosed. The module may include a housing with an actuator interface for attachment to a snowmaking gun or a hydrant. The module may further include a gear motor mounted inside the housing and coupled to the actuator interface, the gear motor configured to selectively drive a snowmaking gun or a hydrant. The module may further include a radio modem and antenna mounted inside the housing. The module may further include a battery mounted inside the housing, the battery coupled to, and configure for powering, the gear motor and the radio modem.

Another embodiment of the snowmaking automation module may further include a control panel mounted to the outside of the housing. The control panel may be configured for a user to manually control the snowmaking automation module and either a snowmaking gun or a hydrant to which it is attached and to configure the automation module for remote operation. Still another embodiment of the snowmaking automation module may further include a solar panel mechanically coupled to the housing and electrically coupled to the battery for passively supplementing life of the battery. Yet another embodiment of the snowmaking automation module may further include a flexible pipe for mechanically coupling the solar panel to the housing and electrically coupling the solar panel to the battery. The flexible pipe may be configured to allow manual aiming of the solar panel to maximize solar power conversion efficiency according to one embodiment. Another embodiment of the snowmaking automation module may further include a global positioning system (GPS) module mounted in the housing and coupled to the radio modem. The GPS module may be configured for determining the position of the automation module and providing position information to the radio modem, which in turn may be relayed to the database, server and user at a web interface located anywhere, including in a base station. Still another embodiment of the snowmaking automation module may further include a handle formed into the housing. The handle may be configured for a user to remove, transport or mount the snowmaking automation module on the equipment (snow gun or hydrant) to which it is attached.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of a snowmaking gun or snowmaking automation module attached to a snowmaking gun as appropriate and according to the present invention. Finally, terms of degree such as "substantially", "about" and "approximately" as used herein mean a reasonable amount of deviation of the modified term such that the end result is not significantly changed.

It will further be understood that the present invention may suitably comprise, consist of, or consist essentially of the component parts, method steps and limitations disclosed herein. However, the invention illustratively disclosed herein suitably may be practiced in the absence of any element which is not specifically disclosed herein.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A snowmaking automation system for controlling the generation of snow, comprising:

a first hydrant for selectively receiving and delivering pressurized water;

a second hydrant for selectively receiving and delivering compressed air, the second hydrant including a valve operable to control output of the second hydrant;

a snowmaking gun coupled to the first hydrant to selectively receive the pressurized water and to the second hydrant to selectively receive the compressed air;

a first automation module coupled to the first hydrant and in communication with the valve operable to control output of the second hydrant; and a second automation module coupled to the snowmaking gun, wherein the first and second automation modules each comprise:

a housing for attachment to the respective first hydrant and snowmaking gun;

a means for communication mounted within the housing, the means for communication being operable to provide user control to the respective first hydrant or second hydrant and snowmaking gun to selectively generate snow using the pressurized water and the compressed air; and a battery mounted within the housing, the battery coupled to and configured for powering the means for communication.

2. The snowmaking automation system according to claim 1, wherein the at least one of the first and the second automation modules further comprises a solar panel mechanically coupled to the housing and electrically coupled to the battery for passively supplementing life of the battery.

3. The snowmaking automation system according to claim 1, wherein the first automation module is in wireless communication with the valve operable to control output of the second hydrant, and wherein the valve of the second hydrant is battery-powered.

4. The snowmaking automation system according to claim 1, wherein at least one of the first automation module and the valve of the second hydrant is in communication with at least one sensor located external to the housing, wherein the first hydrant, the second hydrant, and the snowmaking gun is at a first location where the snow is being generated, and wherein the at least one sensor located external to the housing includes a battery-operated pressure sensor positioned at a second different location.

5. The snowmaking automation system according to claim 1, wherein the at least one of the first and second automation modules further comprises:

a GPS module mounted in the housing and coupled to the means for communication, and wherein the GPS module is operable to determine the position of the at least one of the first and second automation modules and provide position information to the means for communication.

6. The snowmaking automation system according to claim 5, wherein the snowmaking automation system further comprises:

at least one repeater in communication with the at least one of the first and second automation modules, wherein the at least one repeater comprises:

a battery;

a Global Positioning System (GPS) module, wherein the GPS module is configured for determining the position of the at least one repeater; and a solar panel electrically coupled to the battery for passively supplementing life of the battery.

7. The snowmaking automation system according to claim 6, wherein the at least one repeater includes three or more repeaters, wherein the three or more repeaters are operable to determine a location of the at least one of the first and second automation modules based on an output from the respective GPS modules of the three or more repeaters and the at least one of the first and second automation modules.

8. The snowmaking automation system according to claim 1, wherein the at least one of the first and second automation modules includes an interface operable to provide user control of at least one of the first hydrant, the second hydrant, and the snowmaking gun, wherein at least one of the first and second automation modules are in communication with a computer or smartphone, and wherein the computer or smartphone is capable of storing and running a software program configured for remotely interacting with and controlling the at least one of the first and second automation modules via the means for communication and the interface.

9. The snowmaking automation system according to claim 8, further comprising a database for storing data in communication with the computer or smartphone, and further in communication with the at least one of the first and second automation modules, wherein the data includes at least one of water flow rate, water pressure, compressed air pressure, temperature, operational duration, and battery life.

10. A snowmaking automation system for controlling the generation of snow, comprising:

at least one hydrant for selectively receiving and delivering at least one of pressurized water and compressed air;

a snowmaking gun coupled to the at least one hydrant to selectively receive the pressurized water and the compressed air;

a first automation module coupled to the at least one hydrant and a second automation module coupled to the snowmaking gun, wherein the first and second automation modules each comprise:

a housing for attachment to the respective at least one hydrant and snowmaking gun;

a means for communication mounted within the housing, the means for communication being operable to provide user control to or the respective at least one hydrant and snowmaking gun to selectively generate snow using the pressurized water and the compressed air;

a battery mounted inside the housing, the battery coupled to and configured for powering the means for communication; and a solar panel mechanically coupled to the housing and electrically coupled to the battery for passively supplementing life of the battery.

11. The snowmaking automation system according to claim 10, further comprising:

a base station in communication with at least one of the first and second automation modules, the base station configured to provide user control of at least one of the snowmaking gun or the at least one hydrant via the at least one of the first and second automation modules, respectively, and thereby control generation of the snow remotely.

12. The snowmaking automation system according to claim 11, further comprising:

at least one repeater, wherein the base station is in communication with the at least one of the first and second automation modules via the at least one repeater, wherein the at least one repeater comprises:

a battery;

a Global Positioning System (GPS) module; and a solar panel electrically coupled to the battery for passively supplementing life of the battery, and wherein at least one of the first and second automation modules includes a GPS module mounted in the housing and coupled to the means for communication, and wherein the GPS module is operable to determine the position of the at least one of the first and second automation modules and provide position information to the means for communication.

13. The snowmaking automation system according to claim 12, wherein the at least one repeater includes three or more repeaters, wherein the three or more repeaters are operable to determine a location of the at least one of the first and second automation modules based on an output from the respective GPS modules of the three or more repeaters and the at least one of the first and second automation modules.

14. The snowmaking automation system according to claim 10, wherein the at least one of the first and second automation modules includes an interface operable to provide user control of at least one of the at least one hydrant and the snowmaking gun, wherein at least one of the first and second automation modules are in communication with a computer or smartphone, and wherein the computer or smartphone is capable of storing and running a software program configured for remotely interacting with and controlling the at least one of the first and second automation modules via the means for communication and the interface.

15. A snowmaking automation system for controlling the generation of snow, comprising:

at least one hydrant for selectively receiving and delivering at least one of pressurized water and compressed air;

a snowmaking gun coupled to the at least one hydrant to selectively receive the pressurized water and the compressed air;

a first automation module coupled to the at least one hydrant and a second automation module coupled to the snowmaking gun, wherein the first and second automation modules each comprise:

a housing for attachment to the respective at least one hydrant and snowmaking gun;

a motor mounted inside the housing and coupled to an actuator interface, the motor configured to selectively drive the respective at least one hydrant and the snowmaking gun, respectively; and an interface and a means for communication configured to provide user control of the respective at least one hydrant and the snowmaking gun via the first and second automation modules, respectively, and thereby control generation of the snow remotely.

16. The snowmaking automation system according to claim 15, wherein the at least one of the first and second automation modules further comprises:

a battery mounted inside the housing, the battery coupled to and configured for powering the at least the motor and the means for communication; and a solar panel mechanically coupled to the housing and electrically coupled to the battery for passively supplementing life of the battery.

17. The snowmaking automation system according to claim 15, further comprising:

a base station in communication with at least one of the first and second automation modules, the base station configured to provide user control of at least one of the snowmaking gun or the at least one hydrant via the at least one of the first and second automation modules, respectively, and thereby control generation of the snow remotely.

18. The snowmaking automation system according to claim 17, further comprising:

at least one repeater, wherein the base station is in communication with the at least one of the first and second automation modules via the at least one repeater, wherein the at least one repeater comprises:

a battery;

a Global Positioning System (GPS) module; and a solar panel electrically coupled to the battery for passively supplementing life of the battery, and wherein at least one of the first and second automation modules includes a GPS module mounted in the housing and coupled to the means for communication, and wherein the GPS module is operable to determine the position of the at least one of the first and second automation modules and provide position information to the means for communication.

19. The snowmaking automation system according to claim 18, wherein the at least one repeater includes three or more repeaters, wherein the three or more repeaters are operable to determine a location of the at least one of the first and second automation modules based on an output from the respective GPS modules of the three or more repeaters and the at least one of the first and second automation modules.

20. The snowmaking automation system according to claim 15, wherein the at least one of the first and second automation modules includes an interface operable to provide user control of at least one of the at least one hydrant and the snowmaking gun, wherein at least one of the first and second automation modules are in communication with a computer or smartphone, and wherein the computer or smartphone is capable of storing and running a software program configured for remotely interacting with and controlling the at least one of the first and second automation modules via the means for communication and the interface.

* * * * *